US010738577B2

(12) United States Patent
Varkey et al.

(10) Patent No.: US 10,738,577 B2
(45) Date of Patent: Aug. 11, 2020

(54) METHODS AND CABLES FOR USE IN FRACTURING ZONES IN A WELL

(71) Applicant: Schlumberger Technology Corporation, Sugar Land, TX (US)

(72) Inventors: Joseph Varkey, Sugar Land, TX (US); Paul Wanjau, Missouri City, TX (US); David Geehyun Kim, Stafford, TX (US); Maria Auxiliadora Grisanti, Missouri City, TX (US); Sheng Chang, Sugar Land, TX (US); Peter John Richter, Katy, TX (US); Alejandro Andres Pena Gonzalez, Katy, TX (US); Bruno Lecerf, Houston, TX (US); Dmitriy Usoltsev, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 487 days.

(21) Appl. No.: 14/709,879

(22) Filed: May 12, 2015

(65) Prior Publication Data

US 2016/0024902 A1 Jan. 28, 2016

Related U.S. Application Data

(63) Continuation-in-part of application No. 14/628,732, filed on Feb. 23, 2015, now Pat. No. 10,001,613.
(Continued)

(51) Int. Cl.
*E21B 43/26* (2006.01)
*E21B 47/00* (2012.01)
(Continued)

(52) U.S. Cl.
CPC ..... *E21B 43/26* (2013.01); *E21B 23/01* (2013.01); *E21B 33/12* (2013.01); *E21B 34/063* (2013.01);
(Continued)

(58) Field of Classification Search
None
See application file for complete search history.

(56) References Cited

U.S. PATENT DOCUMENTS 2,778,433 A * 1/1957 Brown ..... E21B 23/02 166/330
3,207,224 A * 9/1965 Schramm ..... E21B 23/02 166/217
(Continued)

FOREIGN PATENT DOCUMENTS

GB 2007745 A 5/1979
GB 2197364 A 11/1986
(Continued)

OTHER PUBLICATIONS

Schlumberger Oilfield Glossary entries for "casing", "casing joint", "casing string", "diversion", "chemical diversion", and "bridge plug", accessed Jun. 10, 2017 via www.glossary.oilfield.slb.com.*
(Continued)

*Primary Examiner* — Blake E Michener
(74) *Attorney, Agent, or Firm* — Cathy Hewitt

(57) ABSTRACT

Method and system for multi-stage well treatment wherein an isolating device is tethered with a distributed measurement cable during the treatment of one or more stages. The cable having a cable core including an optical fiber conductor.

29 Claims, 10 Drawing Sheets

Related U.S. Application Data

(60) Provisional application No. 62/027,696, filed on Jul. 22, 2014.

(51) Int. Cl.

| | |
|---|---|
| ***E21B 47/12*** | (2012.01) |
| ***E21B 23/01*** | (2006.01) |
| ***E21B 33/12*** | (2006.01) |
| ***E21B 34/06*** | (2006.01) |
| ***E21B 43/116*** | (2006.01) |
| ***E21B 47/06*** | (2012.01) |
| ***E21B 43/14*** | (2006.01) |
| ***E21B 43/267*** | (2006.01) |

(52) U.S. Cl.

CPC ..... *E21B 43/116* (2013.01); *E21B 43/14* (2013.01); *E21B 43/267* (2013.01); *E21B 47/00* (2013.01); *E21B 47/06* (2013.01); *E21B 47/065* (2013.01); *E21B 47/123* (2013.01)

(56) References Cited

U.S. PATENT DOCUMENTS 3,316,967 A 5/1967 Huitt et al.
4,051,900 A 10/1977 Hankis
4,102,401 A 7/1978 Erbstoesser
4,422,718 A 12/1983 Nakagome et al.
4,504,112 A 3/1985 Gould et al.
4,716,964 A 1/1988 Erbstoesser et al.
4,832,121 A * 5/1989 Anderson ..... E21B 43/26 166/250.09
4,848,467 A 7/1989 Cantu et al.
4,867,241 A 9/1989 Strubhar
4,938,286 A 7/1990 Jennings, Jr.
4,951,751 A 8/1990 Jennings
4,957,165 A 9/1990 Cantu et al.
4,986,355 A 1/1991 Casad et al.
5,295,393 A 3/1994 Thiercelin
5,463,711 A 10/1995 Chu
5,862,861 A 1/1999 Kalsi
5,979,557 A 11/1999 Card et al.
6,006,838 A 12/1999 Whiteley et al.
6,060,662 A 5/2000 Rafie et al.
6,070,666 A 6/2000 Montgomery
6,239,183 B1 5/2001 Farmer et al.
6,278,825 B1 8/2001 Casiraghi et al.
6,392,151 B1 5/2002 Rafie et al.
6,399,546 B1 6/2002 Chang et al.
6,404,961 B1 6/2002 Bonja et al.
6,435,277 B1 8/2002 Qu et al.
6,506,710 B1 1/2003 Hoey et al.
6,543,538 B2 4/2003 Tolman et al.
6,588,266 B2 7/2003 Tubel et al.
6,667,280 B2 12/2003 Chang et al.
6,703,352 B2 3/2004 Dahayanake et al.
6,903,054 B2 6/2005 Fu et al.
6,907,936 B2 6/2005 Fehr et al.
6,949,491 B2 9/2005 Cooke, Jr.
7,036,587 B2 5/2006 Monoz, Jr. et al.
7,051,812 B2 5/2006 McKee et al.
7,060,661 B2 6/2006 Dobson, Sr. et al.
7,267,170 B2 9/2007 Mang et al.
7,303,018 B2 12/2007 Cawiezel et al.
7,380,600 B2 6/2008 Willberg et al.
7,380,602 B2 6/2008 Brady et al.
7,496,258 B1 * 2/2009 Varkey ..... E21B 47/065 385/100
7,506,689 B2 3/2009 Surjaatmadja et al.
7,510,009 B2 3/2009 Cawiezel et al.
7,565,929 B2 7/2009 Bustos et al.
7,775,278 B2 8/2010 Willberg et al.
7,784,541 B2 8/2010 Hartman et al.
7,836,952 B2 11/2010 Fripp
7,845,413 B2 12/2010 Shampine et al.
7,860,362 B2 12/2010 Varkey et al.
7,912,333 B2 3/2011 Varkey et al.
8,016,034 B2 9/2011 Glasbergen et al.
8,109,335 B2 2/2012 Luo et al.
8,167,043 B2 5/2012 Willberg et al.
8,286,703 B2 10/2012 Clapp et al.
8,726,991 B2 5/2014 Boney
8,905,133 B2 12/2014 Potapenko et al.
9,033,041 B2 * 5/2015 Baihly ..... E21B 23/04 166/250.04
9,201,207 B2 12/2015 Varkey et al.
2001/0050172 A1 12/2001 Tolman et al.
2002/0007949 A1 1/2002 Tolman et al.
2004/0045705 A1 * 3/2004 Gardner ..... E21B 43/26 166/250.01
2005/0056418 A1 * 3/2005 Nguyen ..... E21B 47/00 166/250.1
2005/0279501 A1 12/2005 Surjaatmadja et al.
2006/0045442 A1 * 3/2006 Varkey ..... G02B 6/4416 385/102
2006/0102342 A1 * 5/2006 East ..... E21B 43/26 166/250.1
2006/0113077 A1 6/2006 Willberg et al.
2006/0118301 A1 6/2006 East et al.
2006/0175059 A1 8/2006 Sinclair et al.
2006/0185848 A1 8/2006 Surjaatmadja et al.
2006/0225881 A1 * 10/2006 O'Shaughnessy ..... E21B 47/01 166/250.17
2006/0231286 A1 * 10/2006 Varkey ..... H01B 7/1895 174/113 R
2006/0280412 A1 12/2006 Varkey
2007/0029086 A1 2/2007 East, Jr.
2007/0125163 A1 * 6/2007 Dria ..... E21B 17/206 73/152.18
2007/0169935 A1 7/2007 Akbar et al.
2007/0215345 A1 9/2007 Lafferty et al.
2007/0284109 A1 12/2007 East et al.
2008/0000638 A1 1/2008 Burukhin et al.
2008/0031578 A1 2/2008 Varkey et al.
2008/0047707 A1 2/2008 Boney et al.
2008/0053657 A1 3/2008 Alary et al.
2008/0056639 A1 * 3/2008 MacDougall ..... E21B 47/065 385/12
2008/0066910 A1 3/2008 Alary et al.
2008/0078548 A1 4/2008 Pauls et al.
2008/0093073 A1 4/2008 Bustos et al.
2008/0156498 A1 7/2008 Phi et al.
2008/0196896 A1 8/2008 Bustos et al.
2008/0210423 A1 9/2008 Boney
2008/0280788 A1 11/2008 Parris et al.
2008/0280790 A1 11/2008 Mirakyan et al.
2008/0289851 A1 11/2008 Varkey et al.
2009/0025934 A1 1/2009 Hartman et al.
2009/0032258 A1 * 2/2009 Chang ..... E21B 43/117 166/299
2009/0046983 A1 2/2009 Varkey et al.
2009/0054269 A1 2/2009 Chatterji et al.
2009/0062154 A1 3/2009 Windebank et al.
2009/0145610 A1 * 6/2009 Varkey ..... E21B 17/206 166/335
2009/0178807 A1 7/2009 Kaufman et al.
2009/0196557 A1 8/2009 Varkey et al.
2009/0218094 A1 * 9/2009 McLeod ..... E21B 47/06 166/250.1
2009/0283258 A1 11/2009 Poitzsch et al.
2010/0116510 A1 5/2010 Varkey et al.
2010/0155058 A1 6/2010 Gordy et al.
2010/0212906 A1 8/2010 Fulton et al.
2010/0267591 A1 10/2010 Todd et al.
2011/0075978 A1 3/2011 Rose
2011/0090496 A1 * 4/2011 Samson ..... E21B 47/065 356/301
2011/0284214 A1 11/2011 Ayoub et al.
2012/0048570 A1 * 3/2012 Hansen ..... E21B 23/00 166/373
2012/0085531 A1 4/2012 Leising et al.
2012/0168163 A1 * 7/2012 Bertoja ..... E21B 23/04 166/297

(56) References Cited

U.S. PATENT DOCUMENTS

| | | | | |
|---|---|---|---|---|
| 2012/0181034 | A1 | 7/2012 | Bour et al. | |
| 2012/0217014 | A1 | 8/2012 | Groves | |
| 2012/0285692 | A1 | 11/2012 | Potapenko et al. | |
| 2013/0062063 | A1* | 3/2013 | Baihly | E21B 23/04 166/297 |
| 2013/0220604 | A1 | 8/2013 | El-Rabaa et al. | |
| 2013/0233537 | A1 | 9/2013 | McEwen-King et al. | |
| 2013/0264054 | A1 | 10/2013 | East et al. | |
| 2013/0264056 | A1 | 10/2013 | Stout | |
| 2013/0270011 | A1 | 10/2013 | Akkurt et al. | |
| 2013/0272898 | A1 | 10/2013 | Toh et al. | |
| 2014/0014371 | A1 | 1/2014 | Jacob et al. | |
| 2014/0083682 | A1 | 3/2014 | Grigsby et al. | |
| 2014/0096950 | A1 | 4/2014 | Pyecroft et al. | |
| 2014/0138087 | A1 | 5/2014 | Gupta | |
| 2014/0144224 | A1* | 5/2014 | Hoffman | E21B 33/134 73/152.18 |
| 2014/0144226 | A1* | 5/2014 | Shanks | E21B 47/065 73/152.31 |
| 2014/0196893 | A1* | 7/2014 | Vigneaux | C09K 8/72 166/250.07 |
| 2014/0202708 | A1 | 7/2014 | Jacob et al. | |
| 2014/0241677 | A1 | 8/2014 | Sutehall et al. | |
| 2014/0358444 | A1* | 12/2014 | Friehauf | E21B 47/065 702/11 |
| 2014/0367121 | A1 | 12/2014 | Varkey et al. | |
| 2015/0041132 | A1 | 2/2015 | Nelson et al. | |
| 2015/0120194 | A1 | 4/2015 | Chen | |
| 2015/0122541 | A1* | 5/2015 | Varkey | H01B 7/0009 174/70 R |
| 2015/0129229 | A1 | 5/2015 | Ring et al. | |
| 2015/0144347 | A1 | 5/2015 | Brannon et al. | |
| 2015/0170799 | A1 | 6/2015 | Varkey et al. | |
| 2015/0292293 | A1 | 10/2015 | Tolman et al. | |
| 2015/0294763 | A1 | 10/2015 | Varkey et al. | |
| 2015/0369023 | A1 | 12/2015 | MacPhail et al. | |
| 2016/0024902 | A1 | 1/2016 | Richter et al. | |
| 2016/0025945 | A1 | 1/2016 | Wanjau et al. | |
| 2016/0123126 | A1 | 5/2016 | Portman | |
| 2016/0146962 | A1 | 5/2016 | Hayward | |
| 2016/0177693 | A1 | 6/2016 | Gomaa et al. | |
| 2016/0186511 | A1* | 6/2016 | Coronado | E21B 33/128 166/381 |
| 2016/0222736 | A1 | 8/2016 | Varkey et al. | |
| 2016/0333680 | A1 | 11/2016 | Richter et al. | |
| 2018/0022987 | A1 | 1/2018 | Ortega Andrade et al. | |

FOREIGN PATENT DOCUMENTS

| | | | | |
|---|---|---|---|---|
| WO | 2006014951 | A2 | 2/2006 | |
| WO | 2009088317 | A1 | 7/2009 | |
| WO | 2012058296 | A2 | 5/2012 | |
| WO | 2012170382 | A1 | 12/2012 | |
| WO | 2013009773 | A1 | 1/2013 | |
| WO | 2013112811 | A1 | 8/2013 | |
| WO | WO 2015/073005 | * | 11/2013 | E21B 43/267 |
| WO | 2014099207 | A1 | 6/2014 | |
| WO | 2015061655 | A2 | 4/2015 | |
| WO | 2016076747 | A1 | 5/2016 | |

OTHER PUBLICATIONS

Johnson et al., "Large-Volume, High-Rate Stimulation Treatments in Horizontal Wells in the Niobara Formation", Silo Field, Laramie Country, Wyoming, 1993, SPE-25926, 14 pages.

Gallus et al., "Fluid diversion to improve well stimulation", 1972, SPE 3811, 16 pages.

Doerler et al., "Diverting agents: Laboratory study and modeling of resultant zone Injectivities", 1987, SPE 16250, 12 pages.

Hill et al., "Laboratory and theoretical modeling of diverting agent behavior", Journal of Petroleum Technology, 1984, vol. July, pp. 1157-1163.

Hanna, "New fracturing technique leads to improved performance in the Mississippian trend", Journal of Petroleum Technology, 1976, vol. August, SPE 5628, pp. 859-864.

Pritchett et al., "Completion of the KCC 378-H: A case study", 1992, SPE 23948, pp. 189-202.

Morgenthaler et al., "Model Wellbore Evaluation of Diverter Effectiveness Confirmed by Field Results", 1996, SPE 31140, 8 pages.

Bartko et al, "Field and Laboratory Experience in Closed Fracture Acidizing the Lisburne Field, Prudhoe Bay, Alaska", 1992, SPE 24855, 9 pages.

Hu et al., "Evaluation of a-olefin sulfonates for steam diversion", 1984, SPE/DOE 12660, 14 pages.

Gall, "Steam Diversion by Surfactants", 1985, SPE 14390, 9 pages.

Brown et al., "Factors influencing optimum ball sealer performance", Journal of Petroleum Technology, 1963, vol. April, pp. 450-454.

Nasr-El-Din et al., "Laboratory evaluation of biosealers", 2001, SPE 65017, 11 pages.

Erbstoesser, "Improved ball sealer diversion", Journal of Petroleum technology, 1980, vol. November, pp. 1903-1910.

Gabriel et al., "The design of buoyant ball sealer treatments", 1984, SPE 13085, 12 pages.

Zimmerman et al., "Selection of tools for stimulation in horizontal cased hole", 1989, SPE 18995, 12 pages.

Emanuele et al., "A Case Study: Completion and Stimulation of Horizontal Wells with Multiple Transverse Hydraulic Fractures in the lost Hills Diatomite", 1998, SPE-46193, 13 pages.

Badri et al., "Key to the Success Application of Hydraulic Fracturing in an Emerging Coalbed Methane Prospect—An Example from the Peat Coals of Australia", 2000, SPE-64493, 15 pages.

Bellarby et al., "Design and implementation of a high rate acid stimulation through a subsea intelligent completion", 2003, SPE 83950, 10 pages.

Lonnes et al., "Advanced multizone stimulation technology", 2005, SPE 95778, 7 pages.

Rees et al., "Successful Hydrajet Acid Squeeze and Multifracture Acid Treatments in Horizontal Open Hole Using Dynamic Diversion Process and Downhole Mixing", 2001, SPE-71692, 13 pages.

Surjaatmadja et al., "A Successful Acid Treatments in Horizongal Openholes Using Dynamic Diversion and INstant Response Downhole Mixing—An In-Depth Postjob Evaluation", 2002, SPE-75522, 11 pages.

Surjaatmadja et al., "Successful Acid Treatments in Horizontal Openholes Using Dynamic Diversion and Downhole Mixing—An In-Depth Postjob Evaluation", 2002, SPE-75221, 10 pages.

East et al., "Hydrajet Perforating and Proppant Plug Diversion in Multi-Interval Horizontal Well Fracutre Stimulation: Case Histories", 2008, SPE-114881, 17 pages.

McDaniel et al., "Stimulation Techniques for Low-Permeability Reservoirs with Horizontal Completions that Do Not Have Cemented Casing", 2002, SPE-75688, 14 pages.

Eberhard et al., "Application of flow-thru composite frac pugs in tight-gas sand completions", 2003, SPE 84328, 10 pages.

Stipp et al., "Pseudolimited entry: A sand fracturing technique for simultaneious treatment of multiple pays", 1967, SPE 1903, 6 pages.

Cramer, "Stimulating Unconventional Reservoirs: Lessons Learned, Successful Practices, Areas for Improvement", 2008, SPE-114172, 19 pages.

Paccoloni, "A new, effective matrix stimulation diversion technique", SPE Productions & Facilities, 1995, vol. August, pp. 151-156.

Pongratz et al., "Optimizing matrix acid treatments in multilayered reservoir in Russia by applying different diversion techniques", 2005, SPE 94485, 15 pages.

Hewett et al., "Induced Stress Diversion: A Novel Approach to Fracturing Multiple Pay Sands of the NBU Filed", Uintah Co., Utah. 1998, SPE-39945, 9 pages.

Li et al., "Multi-stage fracturing stimulations improve well performance in tight oil reservoirs of the Changqing Oilfields", 2008, IPTC 12303, 8 pages.

(56) References Cited

OTHER PUBLICATIONS

Albertsson, et al., "Aliphatic Polyesters: Synthesis, Properties and Applications", Advances in Polymer Science: Degradable Aliphatic Polyesters, vol. 157, Springer-Verlag Berlin Heidelberg, 2002, pp. 1-40.
Albertsson, et al., "Degradable Aliphatic Polyesters", Advances in Polymer Science, vol. 157, 2002, pp. 1-138.
Bell, et al. "Effective diverting on horizontal wells in the Austin Chalk", SPe 26582—SPE Annual Technical conference and Exhibition, Houston, Texas, 1993, 14 pages.
Blinten, et al., "Stimulating Very Long Gross Intervals", SPE 13709—Middle East Oil Technical Conference and Exhibition, Bahrain, 1985, 12 pages.
Edlund, et al., "Degradable Polymer Microspheres for Controlled Drug Delivery", Advances in Polymer Science: Degradable Aliphatic Polyesters, vol. 157, Springer-Verlag Berlin Heidelberg, 2002, pp. 67-112.
Gallus, et al., "Deformable diverting agent for improved well stimulation", SPE 2161—Journal of Petroleum Technology, vol. 21 (4), 1969, pp. 497-504.
Glasbergen, et al., "Design and field testing of a truly novel diverting agent", SPE 102606—SPE Annual Technical conference and Exhibition, San Antonio, Texas, 2006, 20 pages.
Hakkarainen, et al., "Aliphatic Polyesters: Abiotic and Biotic Degradation and Degradation Products", Advances in Polymer Science: Degradable Aliphatic Polyesters, vol. 157, Springer-Verlag Berlin Heidelberg, 2002, pp. 113-138.
Harrison, N.W., "Diverting agents—history and application", SPE 3653—Journal of Petroleum Technology, vol. 24(5), 1972, pp. 593-598.
Nitters, et al., "Granular diverting agents selection, design and performance", SPE 18884—SPE Production Operations Symposium, Oklahoma City, Oklahoma, 1989.
Potapenko, et al., "Barnett Shale Refracture Stimulations Using a Novel Diversion Technique", SPE 119636—SPE Hydraulic Fracturing Technology Conference, The Woodlands, Texas, 2009, 11 pages.
Smith, et al., "New diverting techniques for acidizing and fracturing", SPE 2751—SPE California Regional Meeting, San Francisco, California, 1969, 8 pages.
Strassner, et al., "Laboratory/field study of oil-soluble resin-diverting agents in Prudhow Bay, Alaska, Acidizing Operations", SPE 20622—SPE Annual Technical Conference and Exhibition, New Orleans, Louisiana, 1990, 10 pages.
Stridsberg, et al., "Controlled Ring-Opening Polymerization: Polymers with Designed Macromolecular Architecture", Advances in Polymer Science: Degradable Aliphatic Polyesters, vol. 157, Springer-Verlag Berlin Heidelberg, 2002, pp. 41-65.
Cipolla et al., "New Algorithms and Integrated Workflow for Tight Gas and Shale Completions", SPE 146872, SPE Annual Technical Conference and Exhibition, Oct. 30-Nov. 2, 2011, 18 pages.
Aviles et al., "Application and Benefits of Degradable Technology in Open-hole Fracturing", SPE 166528, SPE Annual Technical Conference and Exhibition, Sep. 30-Oct. 2, 2013, 9 pages.
Kraemer et al., "A Novel Completion Method for Sequenced Fracturing in the Eagle Ford Shale", SPE-169010-ME, SPE Unconventional Resources Conference—USA, Apr. 1-3, 2014, 10 pages.
Arguijo et al., "Streamlined Completions Process: An Eagle Ford Shale Case History", SPE 162658, 2012 SPE Canadian Unconventional Resources Conference, Oct. 30-Nov. 1, 2012, 17 pages.
Kamal, "Fiber Optic Sensing: Evolution to Value", SPE-167907-MS, SPE Intelligent Energy Conference and Exhibition, Apr. 1-3, 2014, 9 pages.
International Search Report issued in International Patent Application No. PCT/US2016/030491 dated Aug. 3, 2016; 4 pages.
Schlumberger Oilfield Glossary entries for "bullheading", accessed Jun. 6, 2017 via www.glossary.oilfield.slb.com, 1 page.
Schlumberger Oilfield Glossary entries for "spotting", accessed Jun. 6, 2017 via www.glossary.oilfield.slb.com, 1 page.

* cited by examiner

METHODS AND CABLES FOR USE IN FRACTURING ZONES IN A WELL

CROSS-REFERENCE TO RELATED APPLICATIONS

This application is a continuation in part of application U.S. Ser. No. 14/628,732 filed on Feb. 23, 2015 which claims priority and the benefit of U.S. Provisional Patent Application No. 62/027,696 that was filed on Jul. 22, 2014 and is entitled "Methods and Cables for Use in Fracturing Zones in a Well". U.S. Provisional Patent Application No. 62/027,696 and U.S. application Ser. No. 14/628,732 are both incorporated in their entirety herein by reference.

FIELD OF THE DISCLOSURE

The disclosure generally relates to methods and cables for use in fracturing zones in a well. The disclosure broadly relates to multistage fracturing operations.

BACKGROUND

Zones in a well are often fractured to increase production and/or allow production of hydrocarbon reservoirs adjacent a well. To ensure proper fracturing of zones it is useful to monitor the fracturing operations.

Efficient multi-stage well treatment such as fracturing can be a challenging operation that is often complicated by the difficulty of obtaining information about the progress of the treatment of the various stages, as well as the difficulty of properly locating and/or relocating various and different types of downhole tools, devices, objects, materials or other features for treatment of different stages within the same well and/or well interval. Frequently, it can be necessary with some types of multi-stage operations to retrieve downhole tools between stages, so that one stage or sub-stage of treatment can be completed and/or treatment of the next stage or sub-stage can begin, and or to lower a tool, device, object, material or other item from the surface. Each additional trip up or down the well adds time, cost and risk of improper treatment to the operation.

The industry is desirous of multi-stage treatment methods, systems and/or technology with improved efficiency and/or efficacy, e.g., that can effect multi-stage well treatment with better information gathering and/or fewer trips into and/or out of the well.

SUMMARY

Embodiments pertain to methods for multi-stage well treatment, comprising perforating a first interval in the well above a first target depth; deploying to the first target depth an isolation object tethered to a distributed measurement cable from the surface; isolating the well at the first target depth with the isolation object; treating the first perforated interval in a plurality of stages; and concurrently receiving measurements from the distributed measurement cable for monitoring each stage of the treatment.

An example cable for use in the methods includes a cable core. The cable core includes an optical fiber conductor. The optical fiber conductor includes a pair of half-shell conductors. An insulated optical fiber is located between the pair of half-shell conductors. The insulated optical fiber is coupled with the pair of half-shell conductors. The optical fiber conductor also includes an optical fiber conductor jacket disposed about the pair of half-shell conductors.

An example of a system for monitoring fracturing operations includes a cable. The cable comprises a cable core having an optical fiber conductor. The optical fiber conductor includes a pair of half-shell conductors. An insulated optical fiber is located between the pair of half-shell conductors. The insulated optical fiber is coupled with the pair of half-shell conductors, and an optical fiber conductor jacket is disposed about the pair of half-shell conductors. A tool string is connected with the cable, and the tool string has an anchor.

An example method of fracturing a well includes conveying a cable and tool string into a well to a first zone adjacent a heel of a horizontal portion of the well. The method also includes anchoring the cable and tool string in the well. The method also includes applying fracturing fluid to the first zone, and monitoring the fracturing by using the an optical fiber conductor of the cable to acquire cable temperature data, temperature increase and decrease data, vibration data, strain data, or combinations thereof.

The disclosure also relates to systems for multi-stage well treatment, comprising: a perforating system to convey a perforating device to perforate an interval in the well above a target depth; a deployment system to deploy an isolation object tethered to a distributed measurement cable from the surface to the target depth and isolate the well at the first target depth with the isolation object; a treatment system to treat the perforated interval with a treatment fluid in a plurality of stages; and a distributed measurement collection system to receive and interpret measurements from the distributed measurement cable during the treatment to monitor the plurality of the treatment stages.

Embodiments aim at methods for multi-stage well treatment, comprising installing in a casing string an initiation sub adjacent a toe of the well; installing in the casing string a plurality of retention subs at a first target depth and one or more successively higher target depths above the initiation sub; actuating the initiation sub to treat a stage adjacent the initiation sub; perforating a first interval in the well above the first target depth; deploying to the first target depth an isolation object tethered to a distributed measurement cable from the surface; seating the isolation object deployed in the retention sub installed at the first target depth to isolate the well at the first target depth; treating the first perforated interval in a plurality of stages; concurrently receiving measurements from the distributed measurement cable for monitoring each stage of the treatment; detaching the distributed measurement cable from the isolation object seated; and repeating at least the perforation, the deployment, the seating, the treatment, and the monitoring, one or more times with respect to successively higher intervals above the respective one or more successively higher target depths.

DETAILED DESCRIPTION

Figure 1:
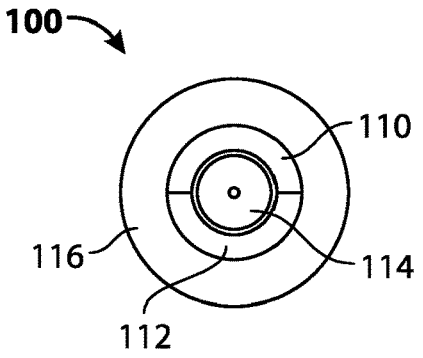
FIG. 1 depicts a schematic of an optical fiber conductor.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

"Above", "upper", "heel" and like terms in reference to a well, wellbore, tool, formation, refer to the relative direction or location near or going toward or on the surface side of the device, item, flow or other reference point, whereas "below", "lower", "toe" and like terms, refer to the relative direction or location near or going toward or on the bottom hole side of the device, item, flow or other reference point, regardless of the actual physical orientation of the well or wellbore, e.g., in vertical, horizontal, downwardly and/or upwardly sloped sections thereof.

As used herein, an open zone, including an open fracture zone, refers to a zone in which there may be fluid communication between the formation and the wellbore extending through the formation. That is, such open zone may refer to an open hole or a section of an open hole (where no casing or liner is cemented in place, serving as a barrier between the formation and the wellbore), or to a cased well which has been modified to allow for such access to the formation. In one or more embodiments, such well may be a cased well with at least one perforation, perforation cluster, a jetted hole in the casing, a slot, at least one sliding sleeve or wellbore casing valve, or any other opening in the casing that provides communication between the formation and the wellbore.

Depth in when used in the present disclosure refer to any displacement or distance being horizontal, vertical or lateral.

Fracture shall be understood as one or more cracks or surfaces of breakage within rock. Fractures can enhance permeability of rocks greatly by connecting pores together, and for that reason, fractures are induced mechanically in some reservoirs in order to boost hydrocarbon flow. Fractures may also be referred to as natural fractures to distinguish them from fractures induced as part of a reservoir stimulation or drilling operation.

The term "fracturing" refers to the process and methods of breaking down a geological formation and creating a fracture, i.e. the rock formation around a well bore, by pumping fluid at very high pressures (pressure above the determined closure pressure of the formation), in order to increase production rates from a hydrocarbon reservoir. The fracturing methods otherwise use conventional techniques known in the art.

The term "treatment", or "treating", refers to any subterranean operation that uses a fluid in conjunction with a desired function and/or for a desired purpose. The term "treatment", or "treating", does not imply any particular action by the fluid.

Monitoring shall be understood broadly as a technique to track the effect of the treatment.

Survey include the measurement versus depth or time, or both, of one or more physical quantities in or around a well. In the present disclosure the term may be used interchangeably with logs.

As used herein, the terms "plug", "sealing agent" or "removable sealing agent" are used interchangeably and may refer to a solid or fluid that may plug or fill, either partially or fully, a portion of a subterranean formation. The portion to be filled may be a fracture that is opened, for example, by a hydraulic or acid fracturing treatment.

Isolating device in the present context include tools such as bridge plugs, cups or sealing elements such as packers.

Deploy shall be understood as running and potentially retrieve a tool in a wellbore. An example of conveyance mean suitable for deploying a toll may be a coiled tubing.

Leak off shall be understood as the fluid leaving the wellbore to enter in the formation. In shale formations, where the rock permeability is extremely small, the leak off requires a fracture which intersects the wellbore. In conventional formations, fluid may leak off in high permeability matrix of the rock such that zones which are not fractured may contribute to leak off Logging shall be broadly interpreted as the operation of recording measurement in the wellbore.

Diverter in the present disclosure shall be understood as a chemical agent or mechanical device used in injection treatments, such as matrix stimulation, to ensure a uniform distribution of treatment fluid across the treatment interval. Injected fluids tend to follow the path of least resistance, possibly resulting in the least permeable areas receiving inadequate treatment. By using some means of diversion, the treatment can be focused on the areas requiring the most treatment. To be effective, the diversion effect should be temporary to enable the full productivity of the well to be restored when the treatment is complete. There are two main categories of diversion: chemical diversion and mechanical diversion. Chemical diverters function by creating a temporary blocking effect that is safely cleaned up following the treatment, enabling enhanced productivity throughout the treated interval. Mechanical diverters act as physical barriers to ensure even treatment.

Distributed measurement cable may be understood as a cable enabling to record changes along a well such as for example temperature changes. Such distributed measurement can be achieved using various devices, an example may be a fiber-optic cable. The distributed temperature is measured by sending a pulse of laser light down the optical fiber. Molecular vibration, which is directly related to temperature, creates weak reflected signals. Such type of devices also enables measuring flow rates by creating a temperature transient and observing its movement along the well.

Cable include cables on which tools are lowered into the well and through which signals from the measurements are passed.

An example cable for use in fracturing zones in a well includes a cable core that has an optical fiber conductor. The optical fiber conductor includes a pair of half-shell conductors. The half-shell conductors can be made from any conductive material. Illustrative conductive materials include copper, steel, or the like. The half-shell conductors can be used to provide data, power, heat or combinations thereof. The material of the conductors can be selected to accommodate the desired resistance of the cable. The half-shell conductors can be used to provide heat, and the heating of the cable can be controlled by selective adjustment of current passing through the half-shell conductors.

An insulated optical fiber is located between the pair of half-shell conductors. The insulated optical fiber can be insulated with a polymer or other insulating material. The insulated optical fiber can be coupled with the pair of half-shell conductors. For example, the insulation of the optical fiber can be bonded with the optical fiber and the inner surfaces of the half-shell conductors. Coupled as used herein can mean physically connected or arranged such that stress or force applied to the half-shell conductors is also applied to the optical fiber. For example, the space between the insulated optical fiber and the half-shell conductors can be minimal to allow coupling of the insulated optical fiber and half-shell conductors. The optical fiber can be a single optical fiber or a plurality of optical fibers. The optical fiber can be a bundle of optical fibers.

An optical fiber conductor jacket can be disposed about the pair of half-shell conductors. The optical fiber conductor jacket can be made from polymer or other materials.

An example cable core can also include a plurality of optical fiber conductors and cable components located in interstitial spaces between the plurality of optical fiber conductors. The cable components can be glass-fiber yarn, polymer, polymer covered metal tubes, composite tubes, metal tubes, or the like. A central cable component can be located between the plurality of optical fiber conductors. In one or more embodiments, a non-conductive material can be located in the cable core to fill void spaces therein.

A foamed-cell polymer, a core jacket, an outer jacket, or combinations thereof can be located about the cable core. The core jacket can be a polymer, a fiber reinforced polymer, a cabling tape, or combinations thereof.

In one or more embodiments, a seam-weld tube can be located about an outer jacket. The seam-welded tube can at least partially embed into the outer jacket.

FIG. 1 depicts a schematic of an optical fiber conductor. The optical fiber conductor 100 has a first half-shell conductor 110, a second half-shell conductor 112, an insulated optical fiber 114, and an optical fiber conductor jacket 116.

Figure 2:
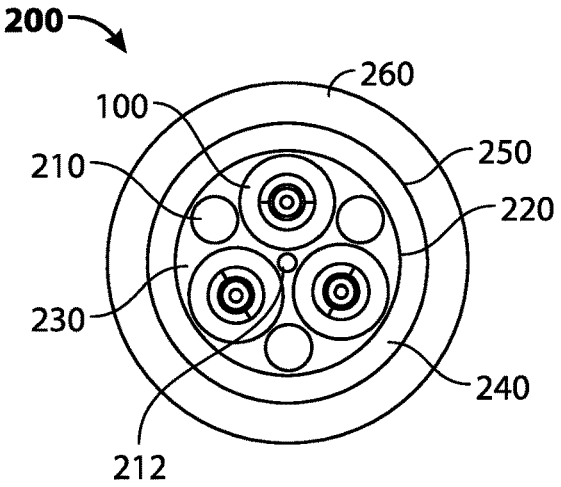
FIG. 2 depicts a cable for use in fracturing operations according to one or more embodiments.

FIG. 2 depicts a cable for use in fracturing operations according to one or more embodiments. The cable 200 includes a plurality of optical fiber conductors 100, a plurality of cable components 210, a core jacket 220, a non-conductive material 230, a foamed-cell polymer 240, an outer jacket 250, and a seam-welded tube 260.

The plurality of optical fiber conductors 100 and the plurality of cable components 210 are cabled about a central cable component 212. The non-conductive material 230 is used to fill spaces or voids in the cable core during cabling. The core jacket 220 is extruded or otherwise placed about the plurality of optical fiber conductors 100, the cable components 220, the central cable component 212, and the non-conductive material 230.

The foamed-cell polymer 240 is placed about the core jacket 220, and an outer jacket 250 is placed about the foamed-cell polymer 240. A seam-welded tube 260 is placed about the outer jacket 250. The seam-welded tube 260 can at least partially embed into the outer jacket 250. For example, a weld bead can embed into the outer jacket 250.

The cable 200 can be connected to a downhole tool and can be arranged to heat and power delivery. For example, a power source at surface can be connected with two of the optical fiber conductors 100, such that one is positive and the other is negative, the third can be used for grounding or floating. The paths can be in a series loop for heating application, and when power needs to be delivered to downhole tools a switch can open the series conductor path and connect each path to designated tool circuit for power delivery.

The self-heating and power supply can be performed concurrently. For example, one conductor can be connected to positive terminal at a power supply at surface and to a designated tool circuit downhole, and another conductor can be connected to a negative terminal at the surface and to a designated tool circuit downhole. Accordingly, power can be delivered downhole and one of the conductor paths can be a return; in one embodiment, if the downhole tool is a tractor, the tractor can be stopped and the wheels closed allowing power to be delivered without movement and at same time the self-heating can occur.

Figure 3:
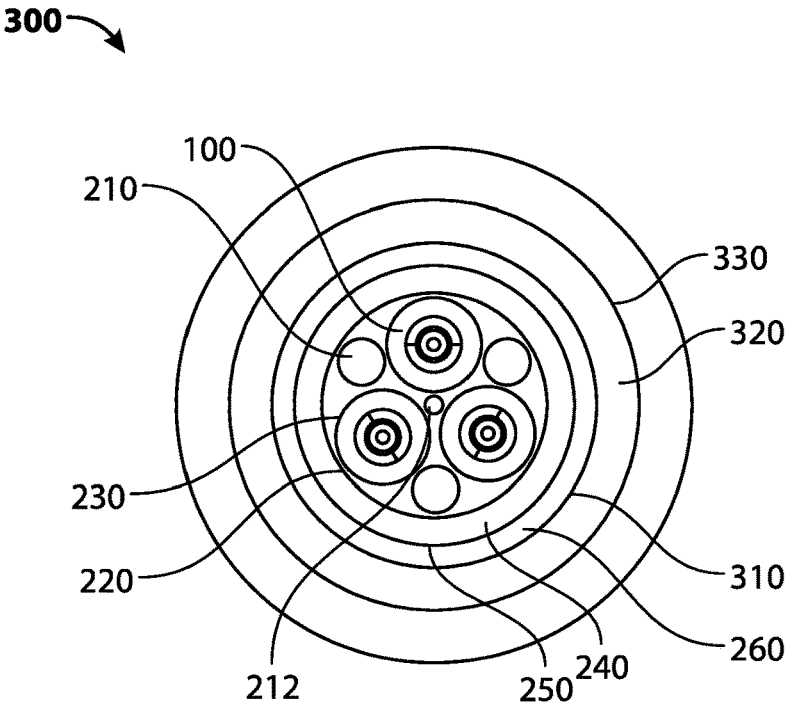
FIG. 3 depicts a schematic of another cable for use in fracturing operations according to one or more embodiments.

FIG. 3 depicts a schematic of another cable for use in fracturing operations according to one or more embodiments. The cable 300 includes the plurality of optical fiber conductors 100, the plurality of cable components 210, the center component 212, the core jacket 220, the non-conductive material 230, the foamed-cell polymer 240, the outer jacket 250, the seam-welded tube 260, a reinforced jacket 310, an additional jacket 320, and an additional seam-welded tube 330.

Figure 4:
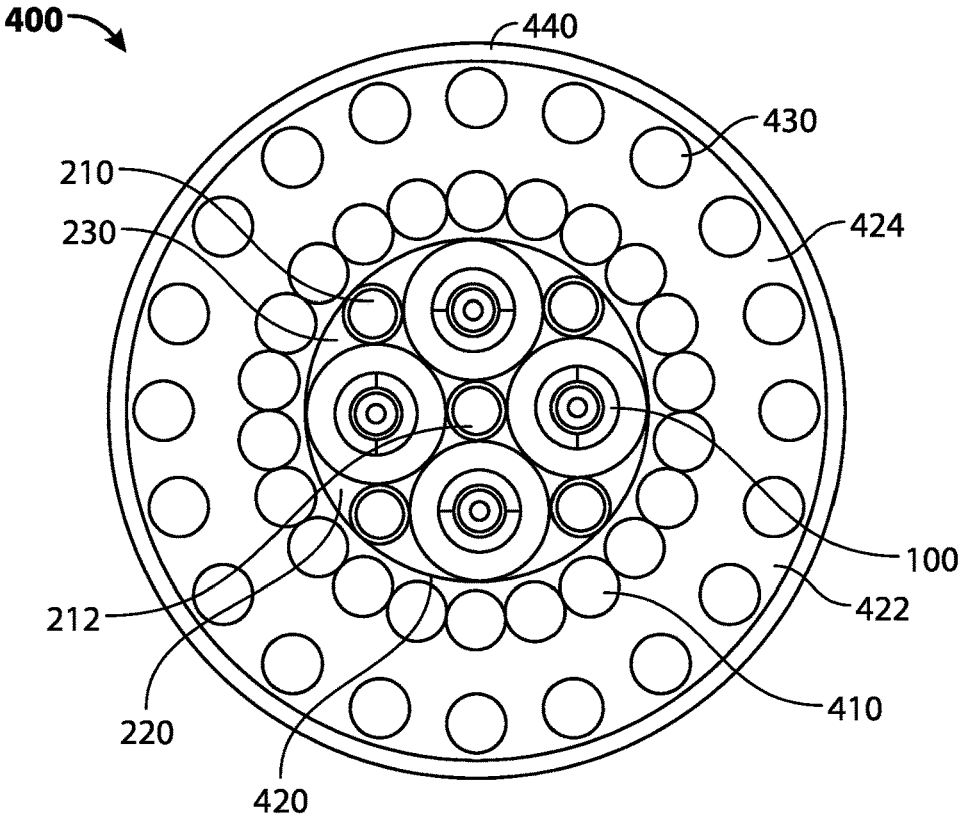
FIG. 4 depicts a schematic of a cable for use in fracturing operations according to one or more embodiments.

FIG. 4 depicts a schematic of a cable for use in fracturing operations according to one or more embodiments. The cable 400 includes a plurality of optical fiber conductors 100, the plurality of cable components 210, the core jacket 220, a first jacket 420, a first layer of strength members 410, a second jacket 422, a second layer of strength members 430, a third jacket 424, and a reinforced outer jacket 440.

The plurality of optical fiber conductors 100 and the plurality of cable components 210 can be cabled about the central component 212. The non-conductive material 230 is used to fill spaces or voids in the cable core during cabling. A core jacket 220 is extruded or otherwise placed about the plurality of optical fiber conductors 100, the cable components 220, the central cable component 212, and the non-conductive material 230. A first jacket 420 can be placed about the cable core jacket 220. The first jacket 420 can be a reinforced polymer, a pure polymer, or the like.

The first layer of strength members 410 can be cabled about the first jacket 420. The first layer of strength members 410 can at least partially embed into the first jacket 420. A second jacket 422 can be placed about the first layer of strength members 410. The second jacket 422 can at least partially bond with the first jacket 420. A second layer of strength members 430 can be cabled about the second jacket 422. The second jacket 422 can separate the first layer of strength members 410 from the second layer of strength members 430 from each other. The strength members in the first strength member layer and the second strength member layer can be coated armor wire, steel armor wire, corrosion resistant armor wire, composite armor wire, or the like.

A third jacket 424 can be placed about the second layer of strength members 420. The third jacket 424 can bond with the second jacket 422. A reinforced outer jacket 430 can be placed about the third jacket 424.

The quad type cable can be connected to a tool string using a 1 by 1 configuration, a 2 by 2 configuration, or a 3 by 1 configuration. For example, a series loop can be formed by connecting two conductors to positive and two conductors to negative in a closed loop and a switching device can be used to open the loop and connect with the downhole tools. In another configuration two of the conductors can be looped for heat generation and two of the conductors can be connected to the downhole tools for power deliver; if the downhole tool is a tractor, the tractor can be stopped and the wheels closed allowing power to be delivered without movement and at same time the self-heating can occur.

In one example, two conductor paths can be connected to power at surface and a third to negative at surface, and each of the conductors can be connected to designated tool circuits downhole for power delivery using one of the conductive paths as a return.

Figure 5:
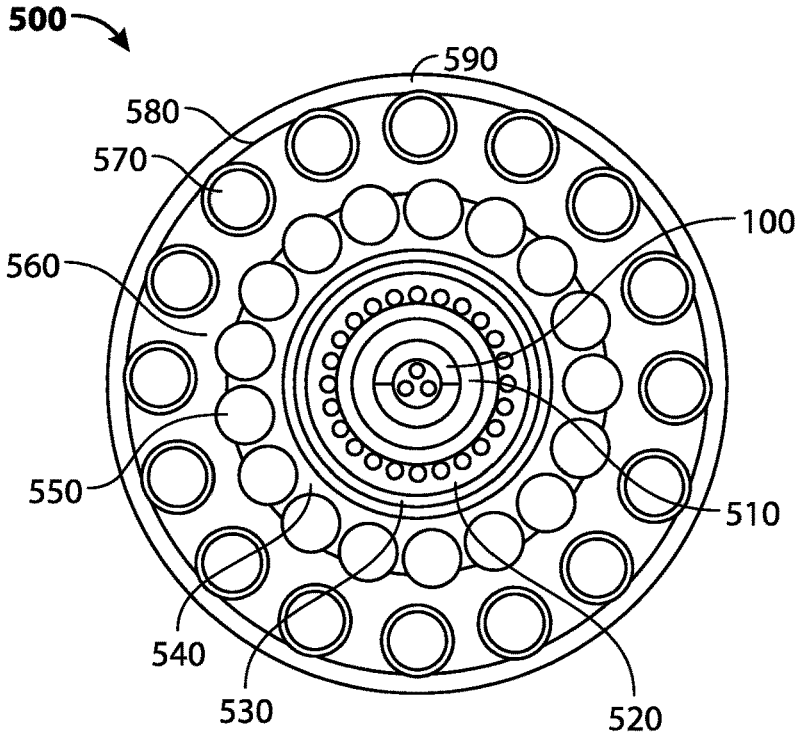
FIG. 5 depicts a schematic of a cable for use in fracturing operations according to one or more embodiments.

FIG. 5 depicts cable according to one or more embodiments. The cable 500 includes one or more optical fiber conductors 100, a double jacket 510, wires 520, an insulating layer 530, a first jacket 540, a first layer of strength members 550, a second jacket 560, a second layer of strength members 570, a third jacket 580, and an outer jacket 590.

The optical fiber conductor 100 has the double jacket 510 located thereabout. The double jacket can include two polymers of differing strength. The wires 520 can be served helically over the double jacket 510. The insulating layer 530 can be placed about the wires 520. The insulating layer can be a polymer or like material. The first jacket 540 can be placed about the insulating layer. The first jacket 540 can be a fiber reinforced polymer.

The first strength member layer 540 can be cabled about the first jacket 540. The first strength member layer 540 can at least partially embed into the first jacket 540. The second jacket 560 can be placed about the first strength member layer 540. The second jacket 560 can bond with the first jacket 540.

The second layer of strength members 570 can be cabled about the second jacket 560, and the second layer of strength members 570 can at least partially embed into the second jacket 560.

The third jacket 580 can be placed about the second layer of strength members 570. The third jacket 580 can bond with the second jacket 560. The outer jacket 590 can be placed about the third jacket 580. The outer jacket 580 can be a fiber reinforced polymer.

Figure 6A:
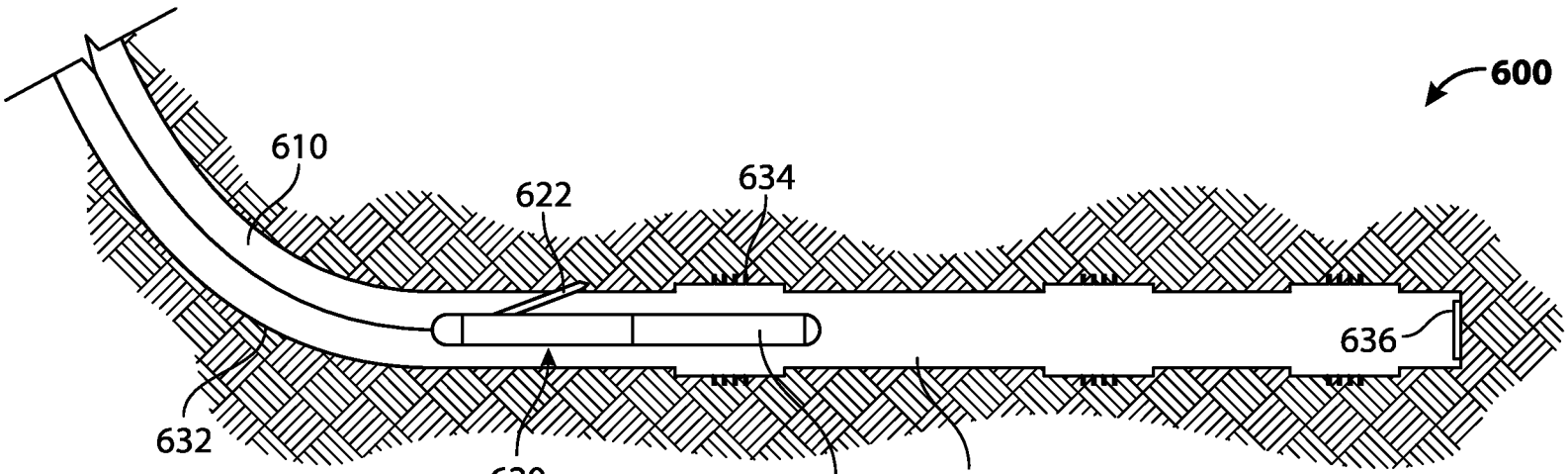
FIG. 6A depicts an example system for monitoring fracturing operations according to one or more embodiments.

FIG. 6A depicts an example system for monitoring fracturing operations according to one or more embodiments. The system 600 includes a cable 610 and a tool string 620. The tool string 620 includes an anchoring device 622 and a logging tool 624. The cable 610 can be any of those disclosed herein or a cable having an optical fiber conductor as described herein. The anchoring device 622 can be a centralizer, a spike, an anchor, or the like. The tool string 620 can have a flow meter and a tension measuring device.

The cable 610 and tool string 620 can be conveyed into a wellbore 630. The wellbore 630 has a heel 632, a plurality of zones 634, and a toe 636. The cable 610 and tool string 620 can be conveyed into the wellbore 630 using any method of conveyance, such as pump down, tractors, or the like. The tool string 620 can be stopped adjacent a first zone adjacent the heel 632. Fracturing fluid can be pumped into the well to open the zone, and the cable 610 can be used to monitor the fracturing operation. After fracturing, diverter fluid can be provided to the well to plug the fractures. The tool string and cable can be conveyed further into the well towards the toe 636 and stopped at intermediate zones. At each of the zones the fracturing operations and diverting can be repeated.

Once all zones are fractured, the plugged fractures can be unplugged. The plugged fractures can be unplugged using now known or future known techniques. The tool string 620 and cable 610 can be left in the wellbore and the zones can be produced, and the logging tool 624 can be used to acquire data. In one or more embodiments, the logging tool 624 can acquire data before the zones are fractured, as the zones are fractured, after the zones are fractured, or combinations thereof.

Figure 6B:
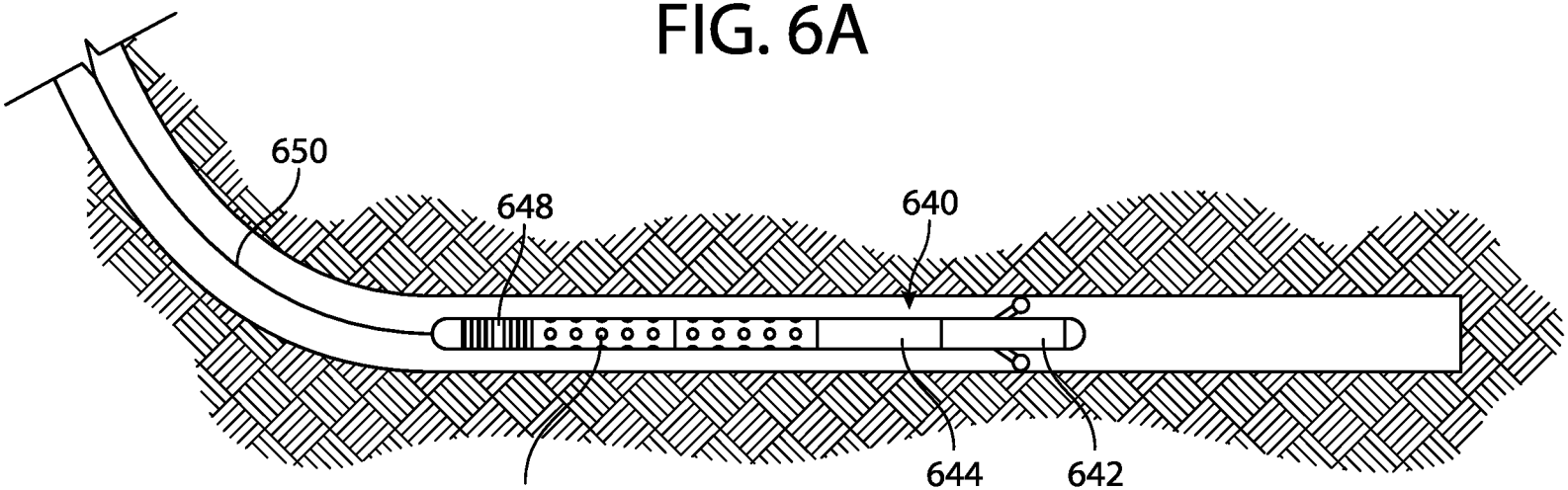
FIG. 6*b* depicts another example system for use in well to perform operations on the well.

FIG. 6*b* depicts another example system for use in well to perform operations on the well. The system includes a tool string 640. The tool string 640 includes a tractor 642, a logging tool 644, a perforating gun or assembly 646, and a plug 648. The tool string 640 can include other equipment to perform additional downhole services. The downhole services can include intervention operations, completion operations, monitoring operations, or the like. A cable 650 can be connected with the tool string 640. The cable 650 can be any of those disclosed therein or substantially similar cables.

Figure 7:
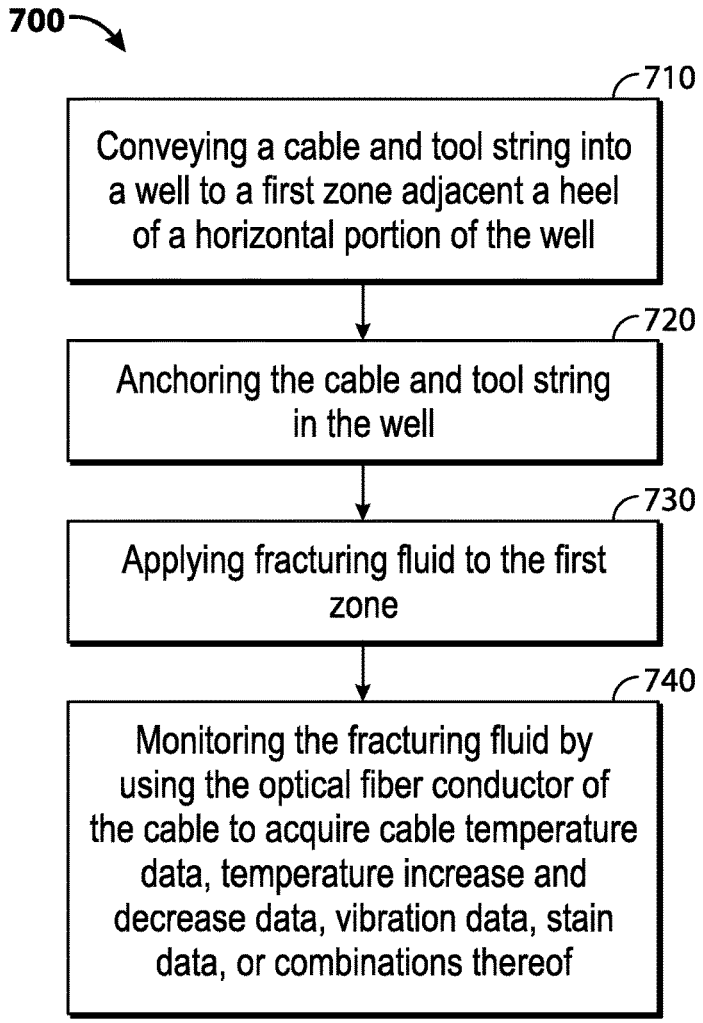
FIG. 7 depicts an example method of fracturing zones in a well according to one or more embodiments.

FIG. 7 depicts an example method of fracturing zones in a well according to one or more embodiments.

The method 700 includes conveying a cable and tool string into a well to a first zone adjacent a heel of a horizontal portion of the well (Block 710). As the cable and tool string are conveyed into the well, the tension on the cable and the flow of fluid can be measured. Fluid flow and cable tension can predict the cable status. For example, if a high flow rate is measured but the cable loses tension, it would indicate the cable is buckling or stuck downhole; if the cable is under tension and low or no flow is detected, the fractures before the cable anchoring mechanism are taking most of the fluid; if the cable is under tension and high flow rate is measured it would indicate that there are no open fractures before the cable anchoring mechanism and the cable should be moving towards the toe of the well. The fluid flow can be measured using a flow meter in the tool string or the self-heated capability of the cable can be used to predict the flow velocity around the cable based on the rate of increase or decrease of the temperature using distributed temperature sensing.

The method can also include anchoring the cable and tool string in the well (Block 720). The method can also include applying fracturing fluid to the first zone (Block 730).

The method also includes monitoring the fracturing by using an optical fiber conductor of the cable to acquire cable temperature data, temperature increase and decrease data, vibration data, strain data, or combinations thereof (Block 740). The hydraulic fracturing process is monitored using the heat-enabled fiber-optic cable. Real-time measurements of cable temperature, temperature increase or decrease rate, vibration, and strain measurements are available to predict which fracture is taking more fluid.

Operations above can be repeated for each zone. Cable tension measurement and fluid flow can be monitored after each zone to prevent damage to the cable.

Figure 8:
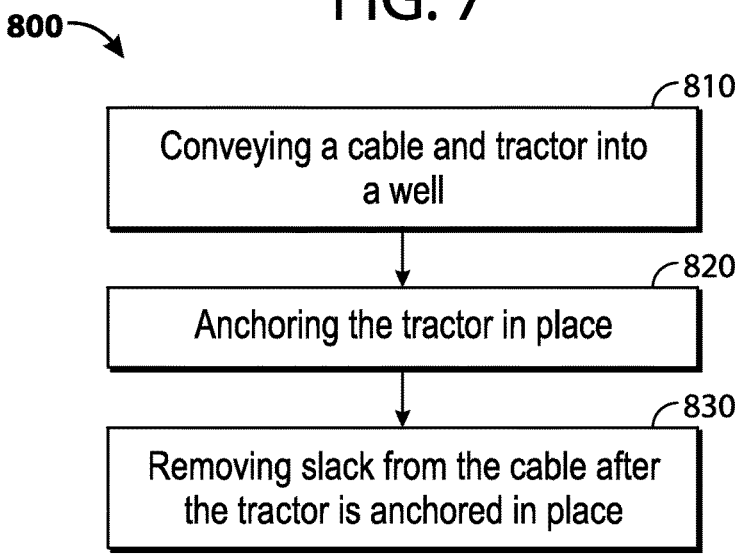
FIG. 8 depicts an example method of placing a cable in well for monitoring.

FIG. 8 depicts an example method of placing a cable in well for monitoring. The method 800 includes conveying a cable and tractor into a well (Block 810). The conveying can be performed using pump down, a tractor, gravity, other known or future known methods, or combinations thereof.

Once the tractor and at least a portion of the cable or located at a desired location in the well, the method can include anchoring the tractor in place (Block 820). The tractor can be anchored in place using anchoring spikes, anchoring pads, or the like.

The method can also include removing slack from the cable after the tractor is anchored in place (Block 830). The slack can be removed from the cable by pulling at the surface or using other known or future know techniques.

The method can also include monitoring the well conditions, operation parameters, or combinations thereof. The monitoring can include hydraulic fracturing monitoring, detecting leaks in a casing, gas production, oil production, electrical submersible pump monitoring, gas lift mandrel monitoring, injection water breakthrough, cross flow shut-in, gas breakthrough, injection profile of water injection wells, steam injection monitoring, CO2 injection performance, zonal isolation monitoring, monitoring for flow behind casing, or other temporary or permanent monitoring operations. The cable can acquire data to aid in fracture height determination, zonal flow contribution determination, evaluation of well stimulation, optimization of gas lift operations, optimization of electrical submersible pumps, other wellbore data, operation data, or production data, or combinations thereof.

The monitoring can be performed in any type of well. Illustrative wells include subsea wells, vertical wells, and horizontal wells. The monitoring can be permanent monitoring or temporary monitoring.

Figure 9:
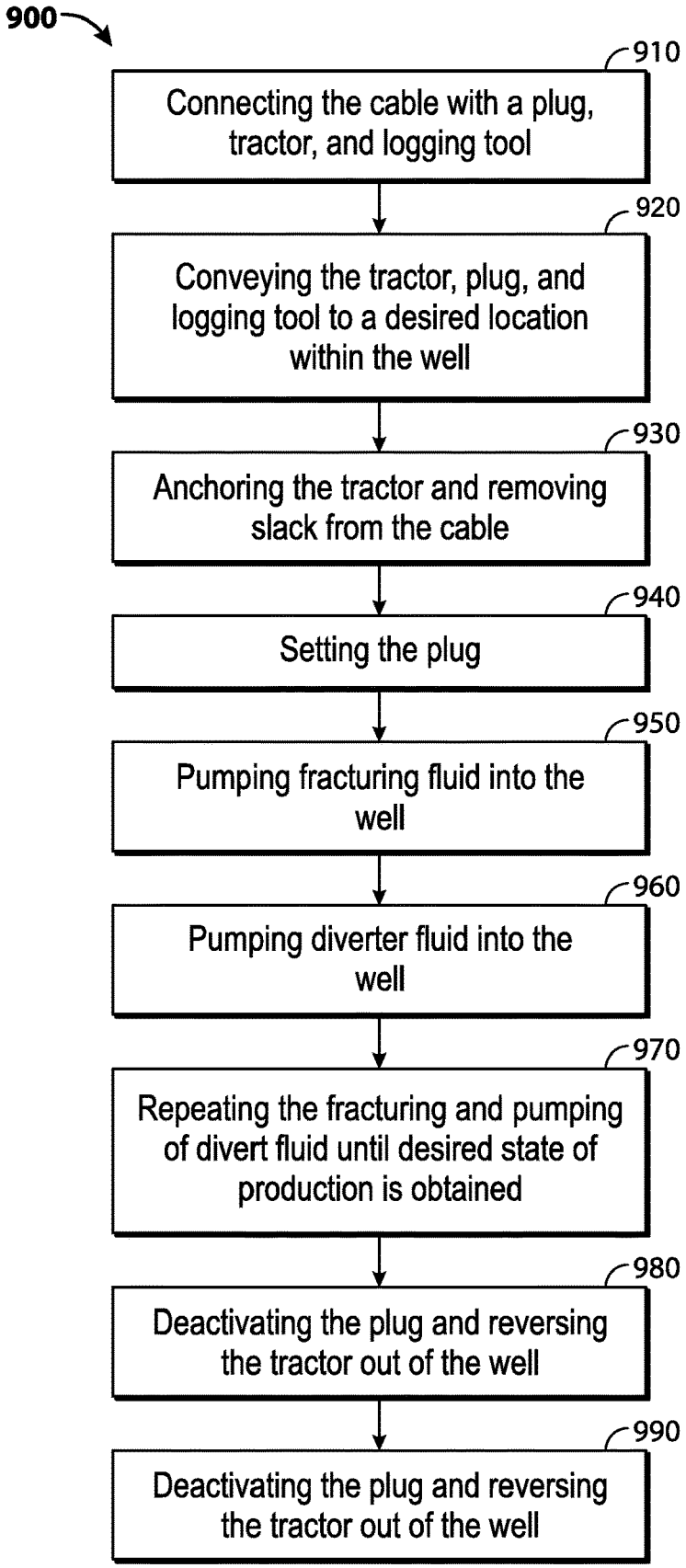
FIG. 9 depicts an example method of placing a cable in a well for hydraulic fracturing and logging in a horizontal well.

FIG. 9 depicts an example method of placing a cable in a well for hydraulic fracturing and logging in a horizontal well. The method 900 includes connecting the cable with a plug, tractor, and logging tool (Block 910). The plug can be a packer or other sealing device. The tractor can be battery operated or powered by the cable.

The method 900 also includes conveying the tractor, plug, and logging tool to a desired location within a well (Block 920). The desired location can be any location in the well. The desired location can be at the toe of a horizontal portion of the well, within an intermediate location of a horizontal portion of the well, or any other portion of the well.

The method also includes anchoring the tractor and removing slack from the cable (Block 930). The method also includes setting the plug (Block 940). The plug can isolate the tractor and logging tool from pressure in the well, corrosive fracturing fluids, or other wellbore condition uphole of the tractor and logging tool. The method includes pumping fracturing fluid into the well (Block 950). The method also includes monitoring the fracturing operation using the cable (Block 960). The monitoring can include obtaining real-time measurements of cable temperature, temperature increase or decrease, vibration, strain measurement, or other parameters.

The method also includes pumping diverter fluid into the well (Block 950). The method also includes repeating the fracturing and pumping of divert fluid until desired state of production is obtained (Block 970). The method also includes deactivating the plug and reversing the tractor out of the well (Block 980). The method also includes logging with the logging tool as the tractor is reversed out of the well (Block 990).

In one or more embodiments of the method, the method can also include monitoring production with the cable as the tractor is reversed out of the well.

In one or more embodiments of the methods disclosed herein the cable can be connected with the tractor, a perforating gun, a logging tool, or combinations thereof. For example, the cable can be connected with a perforating gun and tractor, and the perforating gun can be used to perforate the well before the well is fractured. In another example, the cable can be connected with a perforating gun, tractor, logging tool, and a plug. The well can be perforated, the plug can be set, fracturing operations carried out, and logging can be performed as the tractor is reversed out of the well. Of course, other combinations of downhole hole equipment can be added to the tool string allowing for real-time monitoring using the cable and performance of multiple operations to be performed on a well in a single trip.

Figure 10:
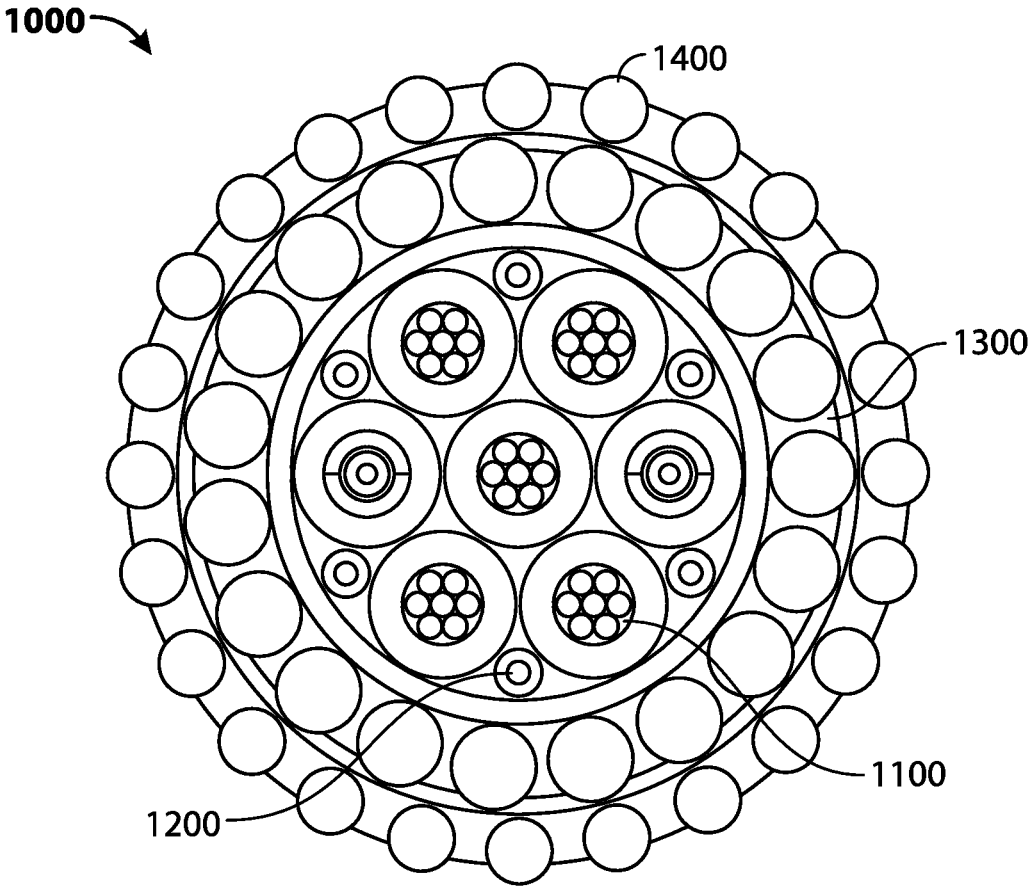
FIG. 10 depicts an example cable with a hepta core for monitoring in a well.

FIG. 10 depicts an example cable for monitoring in a well. The cable 1000 can include a cable core that includes a plurality of conductors 1100 and a plurality of cable components 1200. The conductors 1100 can be any conductor. Illustrative conductors include stranded conductors, fiber optic conductors, other conductors described herein, other know or future known conductors, or combinations thereof. The cable components 1200 can be filler rods, incompressible polymer rods, metallic rods, other now known or future known components, or any combination thereof.

The cable core can have a first armor layer 1300 and a second armor layer 1400 disposed thereabout. The armor layers 1300 and 1400 can include any number of armor wires. The armor layers can be filled with polymer, and the polymer in each armor layer can be bond together. In one or more embodiments, a jacket or the like can separate the first armor layer 1300 from the second armor layer 1400.

For a hepta cable the cable can be connected with the downhole tool in surface power supply using a 3 by 3 configuration. Three conductors can be used for power delivery and 3 conductors can be used for heating. Other configuration can be used. For example, all conductors can be used for heating by connecting in loop, where three conductors are connected to positive of power supply and three conductors are connected to negative of the power supply, and at the tool string a switch can be used to open the loop and connect the conductors to the a designated circuit for power delivery.

In another embodiment, power delivery and heating can be done at the same time. For example, three conductors can be connected to positive at the surface and three conductors can be connected to negative at surface, two or more conductors can be in series for heating application, and the remaining conductive paths can connected to designated tool circuit for power delivery using one conductive path as the return; and when the tractor is stopped the wheels can be retracted allowing for power delivery while avoiding movement.

The cables disclosed herein can be connected with downhole tools and surface power in various ways allowing for continuous power delivery and heating, selective power delivery and heating, or combinations thereof. The connections can be made using now known or future known techniques. The connections can include switches, microprocessors, or other devices to control power delivery and heating.

In some embodiments the disclosure herein relates generally to multi-stage well treatment methods and systems for treating a subterranean formation, using an isolating device tethered with a distributed measurement cable during the treatment of one or more stages.

In some embodiments of the present disclosure, a method for multi-stage well treatment comprises: (a) perforating a first interval in the well above a first target depth; (b) deploying to the first target depth an isolation object tethered to a distributed measurement cable from the surface; (c) isolating the well at the first target depth with the isolation object; (d) treating the first perforated interval in a plurality of stages; and (e) receiving measurements from the distributed measurement cable for monitoring each stage of the treatment, which may optionally be concurrent with the treatment in (d).

In some embodiments, the method may further comprise detaching the distributed measurement cable from the isolation object, and removing the distributed measurement cable from the well. In some embodiments, the method may further comprise leaving the distributed measurement cable in the well, initiating production from the first treated interval and concurrently obtaining measurements from the distributed measurement cable to monitor the production.

In some embodiments, the method may further comprise repeating the perforation (a), deployment (b), isolation (c), treatment (d), and monitoring (e), one or more times with respect to successive intervals above successively higher target depths.

In some embodiments, the method may further comprise treating a stage below the first target depth prior to treatment of the first interval. In some embodiments, the stage below the first target depth is treated prior to perforating the first interval. In some embodiments, treating the stage below the first target depth comprises actuating a rupture disk valve. In some embodiments, the method may further comprise installing the rupture disk valve with a casing string. In some embodiments, treating the stage below the first target depth comprises deploying one or more perforating guns below the first target depth to initiate fluid entry into the stage below the first target depth.

In some embodiments, the method may further comprise installing a retention sub with a casing string at the first target depth. In some embodiments, the method may further comprise installing a landing seat in the retention sub to receive the isolation object, such as, for example, installing the landing seat with a wireline. In some embodiments, the method may further comprise concurrently conveying a landing seat installation tool to the retention sub and a perforating tool to the first interval, with the wireline, e.g., on the same wireline.

In some embodiments, the isolation object comprises a degradable ball. In some embodiments, the method may further comprise removing the isolation object.

In some embodiments, the method may further comprise determining the first target depth using an optimization algorithm based on reservoir quality (RQ) and completion quality (CQ) indexes such as the ones disclosed in SPE 146872 and/or US20130270011.

In some embodiments, the measurements received are selected from fluid flow rate, distributed temperature, distributed vibration, distributed pressure, and combinations thereof. In some embodiments, the treatment (d) comprises fracturing, such as, for example, pumping a treatment fluid comprising proppant laden stages separated by one or more diverter pills. In some embodiments, the method may further comprise adjusting in (d) one or more of respective sizes of the proppant laden stages, number of the diverter pills, and volumes of the diverter pills, in response to the measurements received in (e). In some embodiments the measurements obtained comprise fluid flow rate versus depth during the treatment to monitor fluid flow into the one or more open fracture zones in the interval. In some embodiments, for example, the treatment comprises diverting a fracturing treatment fluid by placing a plug or seal in at least one of the one or more open fracture zones located in the target interval, and wherein the measurement of the fluid flow rate versus depth indicates the effectiveness of the plug/seal, and/or further comprising reinforcing the plug/seal if the it is indicated to be ineffective. In some other embodiments, the cable gathers distributed measurement information to monitor the degradation of one or more degradable diverter plugs or seals placed during the treatment; for example, the cable can gather distributed measurement information to determine if at least one of the one or more degradable diverter plugs or seals has been adequately degraded, and the operational sequence can then progress to introducing a fracturing fluid into the at least one or more unplugged open fracture zones wherein the corresponding diverter plug(s) or seal(s) has been determined to have been degraded.

In some embodiments, the fracturing treatments in (d) comprise sealing at least one open zone of the respective interval with at least one removable sealing agent, selectively removing the removable sealing agent from at least one target zone, and fracturing the at least one target zone, e.g., where the fracturing treatments in (d) occur while at least one open zone of the well is sealed with at least one removable sealing agent. In some embodiments, at least one of: sealing at least one open zone of the interval with at least one removable sealing agent, selectively removing the removable sealing agent from the at least one target zone, or the fracturing of the at least one target zone, is repeated at least one time.

In some embodiments, the method may further comprise sealing the fractured target zone with at least one removable sealing agent. In some embodiments, the the selective removing comprises at least one of perforating, abrading, dissolving, hydrolyzing, oxidizing, degrading, or melting the removable sealing agent from at least one sealed target zone. In some embodiments, the selective removal of the removable sealing agent comprises contacting the at least one target zone with a removal agent by bullheading the removal agent downhole, spotting the removal agent downhole, the use of downhole containers to deliver the removal agent, or a combination thereof. In some embodiments, the removal agent dissolves the removable sealing agent; and wherein the removal agent is at least one of hydrochloric acid, formic acid, acetic acid, hydroxides, ammonia, organic solvents, diesel, oil, water, brines, solutions of organic or non-organic salts, and mixtures thereof.

In some embodiments, the fracturing treatments comprise at least one of a propped fracturing, a non-propped fracturing, a slick-water, acidizing, acid fracturing, injection of chelating agents, stimulating, or squeezing a chemical.

In some embodiments, the removable sealing agent comprises a viscous fluid from at least one of gelled water, viscoelastic surfactant fluids, crosslinked polymer solutions, slick-water, foams, emulsions, dispersions of acid soluble solid particulates, dispersions of oil-soluble resins, and the like, and mixtures thereof. In some embodiments, the removable sealing agent comprises a solid material comprising at least one of acid soluble cement, calcium carbonate, magnesium carbonate, polyesters, magnesium, aluminum, zinc, and their alloys, hydrocarbons with greater than 30 carbon atoms, and carboxylic acids, and the like and derivatives and combinations thereof. In some embodiments, the removable sealing agent comprises manufactured shapes selected from at least one of particulates, sized particulates, fibers, flakes, rods, pellets, and the like, and combinations thereof. In some embodiments, the removable sealing agent comprises a degradable composite material comprising a degradable polymer mixed with particles of a filler material.

In some embodiments, the sealing comprises placing the removable sealing agent in a desired zone in the wellbore by at least one of bullheading the removable sealing agent downhole, spotting the removable sealing agent downhole, or using downhole containers to deliver the removable sealing agent. In some embodiments, the sealing further comprises injecting the sealing material into the selected zone by increasing pressure in the well. In some embodiments, at least one seal of the sealed zones is mechanically strengthened by compacting the seal with an epoxy resin gluing system or an emulsion comprising wax or paraffin.

In some embodiments, at least two zones are sealed with two distinct removable sealing agents which possess the capability of being removed by dissimilar removal processes.

In some embodiments, the method further comprises sealing the fractured zone(s) by at least one of plugging of perforations and/or well or annulus space between a casing and a borehole, reducing permeability of formation rock, modifying the stress field, or changing formation fluid pressure.

In some embodiments, the fracturing treatments in the respective intervals comprise: isolating, or sealing with a removable sealing agent, or a combination thereof, all but one of a plurality of open zones in the respective interval; fracturing the open zone while the other zones in the respective interval are isolated or sealed or a combination thereof; sealing the fractured zone or isolating the section of the respective interval comprising the fractured zone; selectively removing the removable sealing agent from an untreated sealed zone; and repeating the sequence of fracturing the open zone while the other zones are isolated or sealed, isolating or sealing the fractured zone, and selectively removing the removable sealing agent from a sealed un-fractured zone until the desired number of zones are re-fractured.

In some embodiments of the present disclosure, the method for multi-stage well treatment comprises: (a) installing in a casing string an initiation sub adjacent a toe of the well; (b) installing in the casing string a plurality of retention subs at a first target depth and one or more successively higher target depths above the initiation sub; (c) actuating the initiation sub to treat a stage adjacent the initiation sub; (d) perforating a first interval in the well above the first target depth; (e) deploying to the first target depth an isolation object tethered to a distributed measurement cable from the surface; (f) seating the isolation object deployed in (e) in the retention sub installed at the first target depth to isolate the well at the first target depth; (g) treating the first perforated interval in a plurality of stages; (h) concurrently receiving measurements from the distributed measurement cable for monitoring each stage of the treatment in (g); (i) detaching the distributed measurement cable from the isolation object seated in (f); (j) repeating at least the perforation in (d), the deployment in (e), the seating in (f), the treatment in (g), and the monitoring in (h), one or more times with respect to successively higher intervals above the respective one or more successively higher target depths. In some embodiments, each iteration of the repetition in (j) further comprises the detaching in (i) and removing the distributed measurement cable from the well. In some embodiments, the initiation sub comprises a rupture disk valve and the actuation in (c) comprises bursting the rupture disk valve.

In some embodiments, the method further comprises: (k) concurrently conveying landing seat installation tools to the respective retention subs, and perforating tools to the respective intervals, with a wireline; and (l) installing landing seats with the respective landing seat installation tools in the respective retention sub to receive the respective isolation objects. In some embodiments, the method further comprises removing the isolation objects, e.g., prior to perforation and/or treatment of a successive interval.

In some embodiments, the method may further comprise determining the first and successively higher target depths using an optimization algorithm based on reservoir quality (RQ) and completion quality (CQ) indexes indexes such as the ones disclosed in SPE 146872 and/or US20130270011.

In some embodiments, the measurements received are selected from fluid flow rate, distributed temperature, distributed vibration, distributed pressure, and combinations thereof.

In some embodiments, the treatments in (c) and (g) comprise fracturing treatments. In some embodiments, the fracturing treatments in (g) comprise pumping a treatment fluid comprising proppant laden stages separated by one or more diverter pills. In some embodiments, the method further comprises adjustment during the fracturing treatments in (g) one or more of respective sizes of the proppant laden stages, number of the diverter pills, and volumes of the diverter pills, in response to the measurements received in (h).

In some embodiments, the fracturing treatments in (g) comprise sealing at least one open zone of the respective interval with at least one removable sealing agent, selectively removing the removable sealing agent from at least one target zone, and fracturing the at least one target zone, including any of the zone sealing embodiments discussed above.

In further aspect, embodiments of a system for multi-stage well treatment comprise: (a) a perforating system to convey a perforating device to perforate an interval in the well above a target depth; (b) a deployment system to deploy an isolation object tethered to a distributed measurement cable from the surface to the target depth and isolate the well at the first target depth with the isolation object; (c) an interval treatment system to treat the perforated interval with a treatment fluid in a plurality of stages; and (d) a distributed measurement collection system to receive and interpret measurements from the distributed measurement cable during the treatment to monitor the plurality of the treatment stages.

In some embodiments, the perforating, deployment, treatment and distributed measurement collection systems are operable to repeat the perforation, deployment, treatment, and measurement interpretation with respect to one or more successively higher target depths and respective intervals.

In some embodiments the system may further comprise an initiation sub installed in a casing string at a toe of the well to treat a stage below the target depth before deployment of the isolation object to the target depth, such as, for example, a rupture disk valve comprising a plurality of rupture disks operatively associated with respective helical slots.

In some embodiments, the distributed measurement cable comprises a fiber optic sensing system.

In some embodiments the system may further comprise one or more retention subs installed in a casing string at one or more of the target depths; and/or a wireline system comprising an installation tool to install landing seats for the isolation object at each respective retention sub. In some embodiments the wireline system is operable with the perforating system to convey the installation tool and the perforating device on a common wireline.

In some embodiments the isolation object comprises a degradable ball.

In some embodiments the system may further comprise a software module to determine the target depth using an optimization algorithm based on reservoir quality (RQ) and completion quality (CQ) indexes such as the ones disclosed in SPE 146872 and/or US20130270011.

In some embodiments of the system, the treatment fluid comprises a fracturing fluid, such as, for example, proppant laden stages separated by one or more diverter pills. In some embodiments the system may further comprise a treatment control module to adjust one or more of respective sizes of the proppant laden stages, number of the diverter pills, and volumes of the diverter pills, in response to the measurements interpreted by the distributed measurement collection system.

In some embodiments of the system, the treatment fluid may comprise at least one removable sealing agent to seal at least one open zone of the interval, a removal agent to selectively remove the removable sealing agent from at least one target zone, and a fracturing fluid to treat the at least one target zone.

Figure 11A:
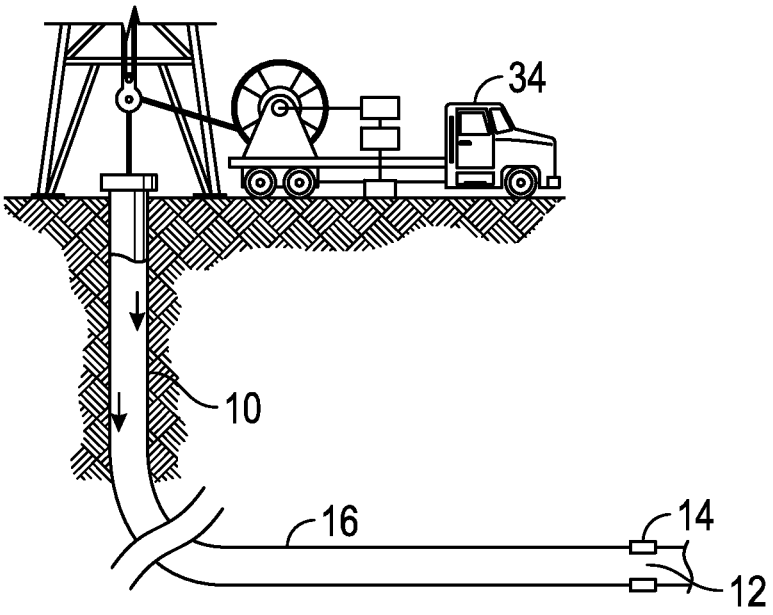
FIG. 11A schematically shows a well configuration according to a first operational sequence in a multi-stage treatment according to embodiments of the disclosure.

With reference to FIGS. 11A-11D, well configurations according to some embodiments of an operational sequence are schematically illustrated. In FIG. 11A, a well 10 is shown following identification of a target depth 12 at which a retaining sub 14 may optionally have been installed, e.g., by running it in the hole with the optional casing 16 during placement thereof, or installing it in an open hole completion, or as a retrofit after installation of the casing. Although described in reference to a cased completion for the purpose of illustration and not by way of limitation, the principles of the present disclosure are likewise applicable to an open hole completion and/or a partially cased completion.

In some embodiments, the target depth is determined using an optimization algorithm based on reservoir quality (RQ) and completion quality (CQ) indexes, such as described in, for example SPE 146872, US20130270011, each of which is incorporated fully herein by reference. Software modules and/or target depth determination services are commercially available, for example, under the trade designations MANGROVE, COMPLETION ADVISOR available from SCHLUMBERGER, and the like. According to some embodiments, the corresponding treatment intervals can be relatively large, e.g., 150 meters or more.

The retaining sub 14, according to some embodiments, as mentioned, is optional, e.g., when the isolation object 18 (see FIG. 11C) is a self-setting isolation tool or device, or otherwise capable of sealing directly to an inside surface of the casing 16. According to some embodiments, the retaining sub 14 may be designed specifically for operability with the type of isolation object 18 to be used. One representative example of a retaining sub 14 is disclosed in U.S. Pat. No. 9,033,041, US application 2014-0014371 or US application 2014-0202708, which is designed to seat a retaining ring 104 (see FIG. 12B) Other suitable retaining subs 14 are commercially available might be used.

Figure 11B:
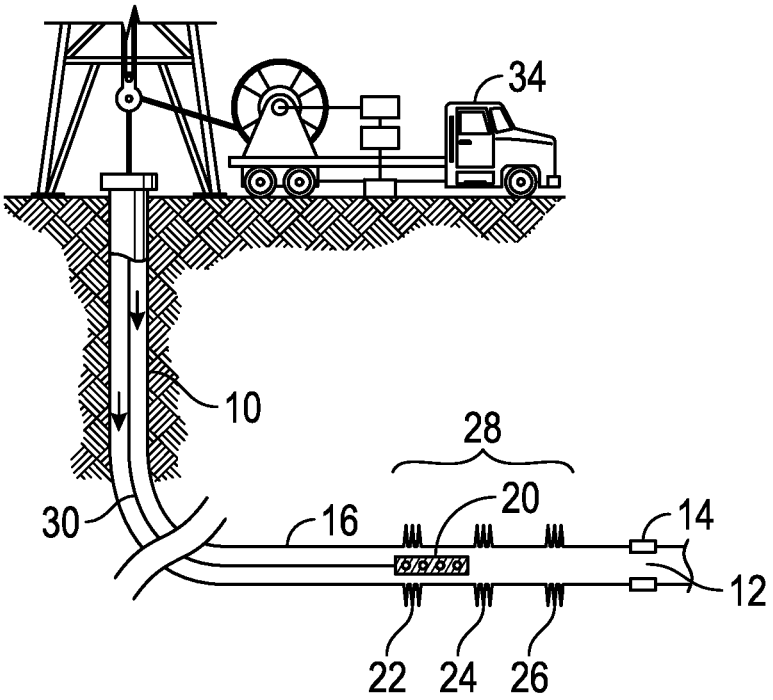
FIG. 11B schematically shows a well configuration according to a second operational sequence in the multi-stage treatment of FIG. 11A in accordance with embodiments of the present disclosure.

With reference to FIG. 11B, in the next operational sequence according to some embodiments, a perforating gun 20 or other suitable perforation device is deployed in the well 10 to perforate a plurality of perforation zones 22, 24, 26 in the interval 28. Suitable perforation devices are described for example in U.S. Pat. No. 6,543,538 which is hereby fully incorporated herein by reference. The perforating gun 20 may be conveyed to the interval 28 via wireline 30, or in some embodiments is conveyed by coiled tubing, tractor, pump-down system, self-propulsion, or the like. After perforating the interval 28, the perforating gun 20 may be removed from the interval 28 and/or the well 10, and/or may be relocated to the next interval to be treated, another location in the well 10 until needed again, or to the surface, or the like.

Figure 11C:
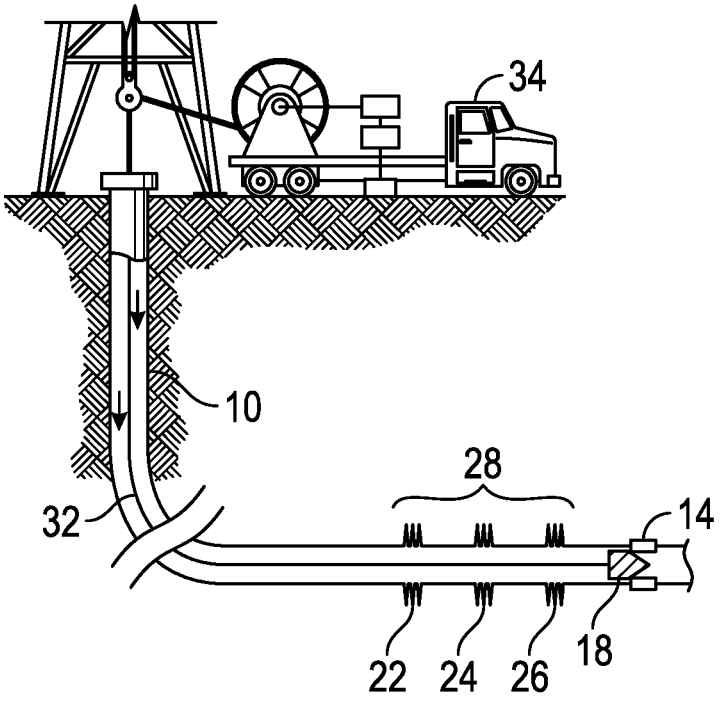
FIG. 11C schematically shows a well configuration according to third operational sequence in the multi-stage treatment of FIGS. 11A and 11B in accordance with embodiments of the present disclosure.

With reference to FIG. 11C, in the next operational sequence according to some embodiments, the isolating object 18 is shown tethered to the distributed measurement cable 32 and deployed to seat in the retaining sub 14 or otherwise at the target depth 12 to isolate the interval 28 from a portion of the well below the target depth 12. The isolating object 18 may be any suitable device, tool, material or other item capable of effecting isolation, such as, for example, a ball, dart, packer, cups, or the like. In some embodiments, the isolation object 18 is pumped into the well 10 via a surface pump-down deployment system 34, which may include a truck and/or skid mounted unit or units for pumping, mixing, control, etc., for example. As motive fluid is pumped from the surface behind the tool 18, it is pushed down to the target depth 12 of the well 10 for seating in the retaining sub 14.

In some embodiments, the isolation object 18 is degradable or otherwise removable, such as, for example, a dissolvable dart, or degradable ball. Degradable balls have increasingly found their way into open-hole graduated ball-seat systems for use in multi-stage stimulation. Schlumberger's ELEMENTAL system, for example, is comprised of a metallic degradable material which can accommodate high differential pressures, as well as high static and dynamic contact stresses. The use of these balls can improve reliability of the ballseat system, and may eliminate the need for interventions such as coiled tubing milling. One advantage of using degradable metals for frac balls is that they may avoid failure mechanisms such as, for example, balls getting stuck in their seats or severely deforming, because the balls degrade over time and thus remove the temporary obstruction effected by the ball with respect to the lower zones of the well. Degradable materials can be selected by one skilled in the art to accommodate the completions practice of the present disclosure due to their significant working range of pressure and temperature.

Suitable degradable isolation objects are described for example in SPE 166528, which is hereby fully incorporated herein.

In some embodiments the cable 32 may be a distributed measurement cable as disclosed herein.

Figure 11D:
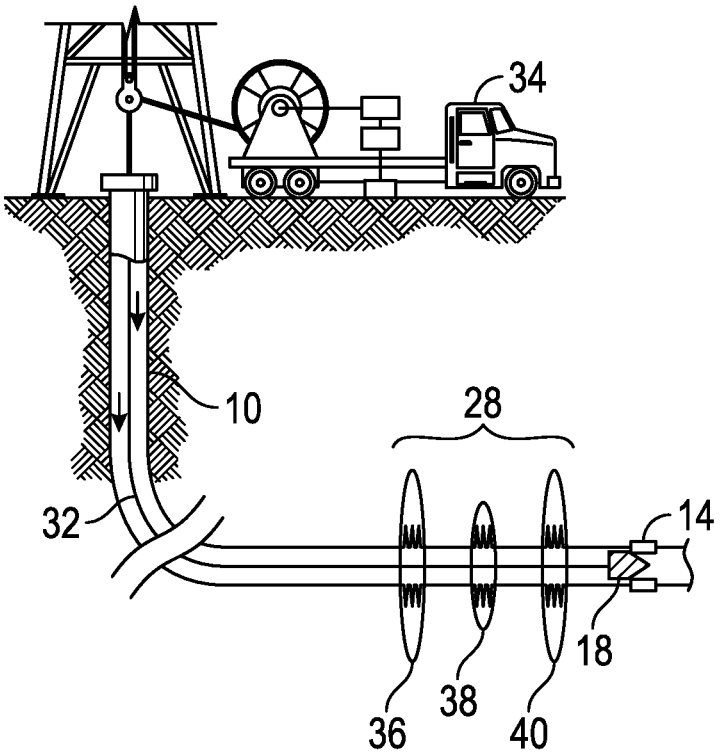
FIG. 11D schematically shows a well configuration according to a fourth operational sequence in the multi-stage treatment of FIGS. 11A, 11B, and 11C in accordance with embodiments of the present disclosure.

With reference to FIG. 11D, in the next operational sequence according to some embodiments, the isolation object 18 is tightly set to isolate the interval 28 from the lower section of the well 10, which may contain additional zones or fractures treated in a previous treatment operation or cycle, and the interval 28 can then be treated with an appropriate treatment fluid pumped into the interval 28 above the activated isolating object 18. In some embodiments, the interval 28 is treated by injecting a fracturing treatment fluid simultaneously or sequentially via the perforation zones 22, 24, 26 (see FIG. 11A) to form respective fracture zones 36, 38, 40, using one or more treatments available for fracturing an interval of a well as discussed hereafter.

Where the cable 32 is provided with distributed measurement functionality in some embodiments, measurement information gathered along the length thereof may be used during the fracturing or other treatment for monitoring of the fracturing treatment while (real-time) it is being executed, or afterwards. For example, the cable 32 can be used in some embodiments to measure the fluid flow rate as a function of depth, information which can be used to monitor the volume and/or rate at which each fracture 36, 38, 40 receives treatment fluid during the fracturing or other treatment, e.g., the manner in which the treatment fluid redistributes along the treated interval as the net pressure in each fracture zone varies and influences the flow profile; or the effectiveness of a seal, plug or diverter that may be located and/or removed at the fracture as part of the treatment process. Such information in some embodiments can facilitate adjustments to the treatment pumping or composition schedule, including the pumping rate and/or pressure, e.g., in fracturing treatments which use a diverter, where the effectiveness of the diverter at the plugged fractures can be monitored and corrective actions can be taken in response to the measurements observed during the treatment. For example, in some embodiments where excessive leakage is detected into a fracture zone at which diverter has been placed, an additional diverter treatment and/or diverter reinforcement treatment may be pumped to the fracture zone in question.

In some embodiments, the degradation of any diversion material in the one or more of the perforation zones 22, 24, 26 can be monitored by maintaining a positive pressure from wellbore 10 and monitoring the profile of fluid flow, e.g., via the distributed measurement cable 32, during the process of degradation of the diverting material. In some embodiments, once it is determined and/or confirmed via distributed measurement cable 32 that the perforation zones which are desired to be treated, are opened again by removal of the respective plugs, then the material in the plugs can be considered sufficiently degraded such that the respective perforation zones 22, 24 and/or 26 are ready for initiation of the fracturing treatment and/or other receipt of treatment fluid to form the corresponding fracture zones 36, 38, 40.

In the case of fracturing treatments according to some embodiments herein, the number of stages and depth of stages in the interval 28 may vary according to different embodiments, and if desired, depths and/or pumping schedules can be varied in response to information acquired with the monitor cable 32, e.g., in real time. In one or more embodiments, examples of sources of the information used for making such decisions may comprise magnitude of the treating pressure, temperature log data, microseismic including real-time microseismic data, or any other known sources of information that may be beneficial to the decision making process. In any of the embodiments discussed herein, this process may then be repeated until completion of the desired number of stages in the interval 28 and formation of the fracture zones 36, 38, 40, e.g., toe-to-heel (40, 38, 36), or heel-to-toe (36, 38, 40), or a combination thereof.

In any of the embodiments discussed herein, once all stages are completed, the monitor cable 32 may be placed or left at least temporarily at a desired depth in the well 10, e.g., along the length of any treated or other zones to be produced, while production flow back is initiated (or longer if desired), and the monitor cable 32 can be used to collect data to determine a production flow profile. In these embodiments, the cable 32 can be placed or left in the well 10 at least until such time as the production monitor service is no longer required, or can be placed or left in the well 10 for later re-establishment of production monitoring.

Suitable multi-stage interval treatment systems and methods using diverter materials are described in SPE 169010, and U.S. Pat. No. 8,905,133, which are hereby fully incorporated herein by reference.

In some embodiments disclosed herein the plugs used to seal the pre-existing and/or newly created fractures and the methods of using them may involve controllable and/or selective chemical induced zonal sealing/unsealing for treatment diversion during multistage well stimulation operations, such as, for example, dividing the wellbore 10 into multiple zones, e.g., well sections, plugging at least one fracture zone with one or more various removable sealing agents, then selectively removing the sealing agents and unsealing one or more previously sealed zones so that the unsealed zone(s) may be treated.

The embodiments of methods for selective zonal sealing/unsealing for treatment diversion between the stages of a multi-stage well presented herein are applicable for stimulating wells regardless of their completion type. The selectivity of the zonal sealing/unsealing as used herein may be conferred by either selective placement or selective reaction. Selective placement may involve selecting the location at which the sealing agent is applied or removed, which may be enabled by placing a tool at the depth where the sealing or removing takes place. For example, a coiled tubing line spotted at the depth where the sealing agent is to be removed may then use abrasive jet perforating to perforate through the seal or to spot a chemical capable of removing the seal. Selective reaction may involve a selective degradation time for the sealing agent or a selective chemical agent for removing selected sealing agents. In some embodiments, selective degradation may occur via a sealing agent degrading at a faster rate in the presence of a certain wellbore fluid or chemical than another sealing agent used to seal the wellbore. Selective reaction and removal of a sealing agent may occur when a chemical removing agent reacts or interacts with certain sealing agents while being substantially inert towards other sealing agents. For example, the chemical removing agent may react or interact to induce hydrolysis, oxidation, dissolution, and/or degradation of the sealing agent.

If further treatments of different zones of the wellbore are warranted or desired, the treated target zone of the wellbore may optionally be sealed with at least one or more removable sealing agents. It is another possibility to leave the treated target zone unsealed. The removable sealing agents sealing the next target zone(s) may be selectively removed to enable treatment of the next target zone(s). In this way, the treatment of the desired wellbore zone may be completed by repeating the process as many times as desired. Eventually, if no further treatments are warranted or desired, a final selective removal of at least one of the removable sealing agents in the sealed zones may be performed to reach the end of the job and allow for production through the wellbore.

As mentioned, the method may begin with a well having at least one zone open. In one or more embodiments, the well may not initially contain an open zone or may not contain an open zone in a desired portion of the well, and the open zone may be created by perforating the casing with perforating charges, jetting with a coiled tubing (CT) line or slick-line conveyed tools, cutting the casing, or any other known methods for creating an open zone in a well. In some embodiments, manipulating at least one sliding sleeve or wellbore casing valve within the wellbore or the creation of an open zone within a wellbore may enable access to an untreated zone of the formation.

At least one open zone may be sealed (temporarily) with a removable sealing agent that may be a dissolvable or otherwise removable composition. As used herein, sealing of an open zone (or zones) may involve reduction of a fluid's ability to flow from the wellbore into the open zone, which may include reduction in the permeability of the zone. As used herein, sealing an open zone refers to sealing the open zone at the sandface and does not involve plugging the wellbore itself, which is referred to instead as isolation of the wellbore. In particular, isolation may be used to isolate an entire section of the wellbore from any treatment or operations occurring in more upstream sections of the wellbore, whereas sealing, as used herein, leaves the wellbore open and instead seals the sandface.

The removable sealing agents may be any materials, such as solid materials (including, for example, degradable solids and/or dissolvable solids), that may be removed within a desired period of time. In some embodiments, the removal may be assisted or accelerated by a wash containing an appropriate reactant (for example, capable of reacting with one or more molecules of the sealing agent to cleave a bond in one or more molecules in the sealing agent), and/or solvent (for example, capable of causing a sealing agent molecule to transition from the solid phase to being dispersed and/or dissolved in a liquid phase), such as a component that changes the pH and/or salinity within the wellbore. In some embodiments, the removal may be assisted or accelerated by a wash containing an appropriate component that changes the pH and/or salinity. The removal may also be assisted by an increase in temperature, for example, when the treatment is performed before steam flooding, and/or a change in pressure.

In some embodiments, the removable sealing agents may be a degradable material and/or a dissolvable material. A degradable material refers to a material that will at least partially degrade (for example, by cleavage of a chemical bond) within a desired period of time such that no additional intervention is used to remove the seal. For example, at least 30% of the removable sealing agent may degrade, such as at least 50%, or at least 75%. In some embodiments, 100% of the removable sealing agent may degrade. The degradation of the removable sealing agent may be triggered by a temperature change, and/or by chemical reaction between the removable sealing agent and another reactant. Degradation may include dissolution of the removable sealing agent.

For the purposes of the disclosure, the removable sealing agents may have a homogeneous structure or may also be non-homogeneous including porous materials or composite materials. A removable sealing agent that is a degradable composite composition may comprise a degradable polymer mixed with particles of a filler material that may act to modify the degradation rate of the degradable polymer. In some embodiments, the particles of a filler material may be discrete particles. The particles of the filler material may be added to accelerate degradation and the filler particles may be from 10 nm to 5 microns in mean average size. In some embodiments, smaller filler particles may further accelerate degradation in comparison to larger filler particles. The filler particles may be water soluble materials, include hygroscopic or hydrophilic materials, a meltable material, such as wax, or be a reactive filler material that can catalyze degradation, such as a filler material that provides an acid, base or metal ion. In some embodiments, the filler particles may have a protective coating, thus allowing them to be mixed with a degradable polymer and/or heated during manufacturing processes, such as extrusion, whilst retaining their structural and compositional characteristics, the structural and compositional characteristics of the degradable polymer, and their capability for degradation. The coatings can also be chosen to delay degradation or fine tune the rate of degradation for particular conditions.

Examples of water soluble filler materials comprise NaCl, ZnCl2, CaCl2, MgCl2, NaCO3, KCO3, KH2PO4, K2HPO4, K3PO4, sulfonate salts, such as sodium benzenesulfonate (NaBS), sodium dodecylbenzenesulfonate (NaDBS), water soluble/hydrophilic polymers, such as poly (ethylene-co-vinyl alcohol) (EVOH), modified EVOH, SAP (super absorbent polymer), polyacrylamide or polyacrylic acid and poly(vinyl alcohols) (PVOH), and the mixture of these fillers. Examples of filler materials that may melt under certain conditions of use include waxes, such as candelilla wax, carnauba wax, ceresin wax, Japan wax, microcrystalline wax, montan wax, ouricury wax, ozocerite, paraffin wax, rice bran wax, sugarcane wax, Paricin 220, Petrac wax 165, Petrac 215, Petrac GMS Glycerol Monostearate, Silicon wax, Fischer-Tropsch wax, Ross wax 140 or Ross wax 160. Examples of reactive filler materials that may accelerate degradation include metal oxides, metal hydroxides, and metal carbonates, such as Ca(OH)2, Mg(OH)2, CaCO3, Borax, MgO, CaO, ZnO, NiO, CuO, Al2O3, a base or a base precursor. The degradable composites may also include a metal salt of a long chain (defined herein as C8) fatty acids, such as Zn, Sn, Ca, Li, Sr, Co, Ni, K octoate, stearate, palmate, myrisate, and the like. In some embodiments, the degradable composite composition comprises a degradable PLA mixed with filler particles of either i) a water soluble material, ii) a wax filler, iii) a reactive filler, or iv) combinations thereof, said degradable composite may degrade in 60° C. water in less than 30, 14 or 7 days.

Solid removable sealing agents for use as the sealing agent may be in any suitable shape: for example, powder, particulates, beads, chips, or fibers, and may be a combination of shapes. When the removable sealing agent is in the shape of fibers, the fibers may have a length of from about 2 to about 25 mm, such as from about 3 mm to about 20 mm. In some embodiments, the fibers may have a linear mass density of about 0.111 dtex to about 22.2 dtex (about 0.1 to about 20 denier), such as about 0.167 to about 6.67 dtex (about 0.15 to about 6 denier). Suitable fibers may degrade under downhole conditions, which may include temperatures as high as about 180° C. (about 350° F.) or more and pressures as high as about 137.9 MPa (about 20,000 psi) or more, in a duration that is suitable for the selected operation, from a minimum duration of about 0.5, about 1, about 2 or about 3 hours up to a maximum of about 24, about 12, about 10, about 8 or about 6 hours, or a range from any minimum duration to any maximum duration.

The removable sealing agents may be sensitive to the environment, so dilution and precipitation properties may be taken into account when selecting the appropriate removable sealing agents. The removable sealing agent used as a sealer may survive in the formation or wellbore for a sufficiently long duration (for example, about 3 hours to about 6 hours). The duration may be long enough for wireline services to perforate the next pay sand, subsequent fracturing treatment (s) to be completed, and the fracture to close on the proppant before it completely settles, providing an improved fracture conductivity.

Further suitable removable sealing agents and methods of use thereof include those described in U.S. Patent Application Publication Nos. 2006/0113077, 2008/0093073, and 2012/0181034, the disclosures of which are incorporated by reference herein in their entireties. Such removable sealing agents include inorganic fibers, for example of limestone or glass, but are more commonly polymers or co-polymers of esters, amides, or other similar materials. They may be partially hydrolyzed at non-backbone locations. Any such materials that are removable (due in-part because the materials may, for example, degrade and/or dissolve) at the appropriate time under the encountered conditions may also be employed as removable sealing agents in the methods of the present disclosure. For example, polyols containing three or more hydroxyl groups may be used. Suitable polyols include polymeric polyols that solubilizable upon heating, desalination or a combination thereof, and contain hydroxyl-substituted carbon atoms in a polymer chain spaced from adjacent hydroxyl-substituted carbon atoms by at least one carbon atom in the polymer chain. The polyols may be free of adjacent hydroxyl substituents. In some embodiments, the polyols have a weight average molecular weight from about 5000 to about 500,000 Daltons or more, such as from about 10,000 to about 200,000 Daltons.

Further examples of removable sealing agents include polyhydroxyalkanoates, polyamides, polycaprolactones, polyhydroxybutyrates, polyethyleneterephthalates, polyvinyl alcohols, polyethylene oxide (polyethylene glycol), polyvinyl acetate, partially hydrolyzed polyvinyl acetate, and copolymers of these materials. Polymers or co-polymers of esters, for example, include substituted and unsubstituted lactide, glycolide, polylactic acid, and polyglycolic acid. For example, suitable removable materials for use as plugging agents include polylactide acid; polycaprolactone; polyhydroxybutyrate; polyhydroxyvalerate; polyethylene; polyhydroxyalkanoates, such as poly[R-3-hydroxybutyrate], poly[R-3-hydroxybutyrate-co-3-hydroxyvalerate], poly[R-3-hydroxybutyrate-co-4-hydroxyvalerate], and the like; starch-based polymers; polylactic acid and copolyesters; polyglycolic acid and copolymers; aliphatic-aromatic polyesters, such as poly(c-caprolactone), polyethylene terephthalate, polybutylene terephthalate, and the like; polyvinylpyrrolidone; polysaccharides; polyvinylimidazole; polymethacrylic acid; polyvinylamine; polyvinylpyridine; and proteins, such as gelatin, wheat and maize gluten, cottonseed flour, whey proteins, myofibrillar proteins, casins, and the like. Polymers or co-polymers of amides, for example, may include polyacrylamides.

Removable sealing agents, such as, for example, degradable and/or dissolvable materials, may be used in the sealing agent at high concentrations (such as from about 10 lbs/1000 gal to about 1000 lbs/1000 gal, or from about 30 lbs/1000 gal to about 750 lbs/1000 gal) in order to form temporary plugs or bridges. The removable material may also be used at concentrations at least 4.8 g/L (40 lbs/1,000 gal), at least 6 g/L (50 lbs/1,000 gal), or at least 7.2 g/L (60 lbs/1,000 gal). The maximum concentrations of these materials that can be used may depend on the surface addition and blending equipment available. [[convert to SI/metric]]

Suitable removable sealing agents also include dissolvable materials and meltable materials (both of which may also be capable of degradation). A meltable material is a material that will transition from a solid phase to a liquid phase upon exposure to an adequate stimulus, which is generally temperature. A dissolvable material (as opposed to a degradable material, which, for example, may be a material that can (under some conditions) be broken in smaller parts by a chemical process that results in the cleavage of chemical bonds, such as hydrolysis) is a material that will transition from a solid phase to a liquid phase upon exposure to an appropriate solvent or solvent system (that is, it is soluble in one or more solvents). The solvent may be the carrier fluid used for fracturing the well, or the produced fluid (hydrocarbons) or another fluid used during the treatment of the well. In some embodiments, dissolution and degradation processes may both be involved in the removal of the sealing agent.

Such removable sealing agents, for example dissolvable, meltable and/or degradable materials, may be in any shape: for example, powder, particulates, beads, chips, fibers, or a combination of shapes. When such material is in the shape of fibers, the fibers may have a length of about 2 to about 25 mm, such as from about 3 mm to about 20 mm. The fibers may have any suitable denier value, such as a denier of about 0.1 to about 20, or about 0.15 to about 6.

Examples of suitable removable fiber materials include polylactic acid (PLA) and polyglycolide (PGA) fibers, glass fibers, polyethylene terephthalate (PET) fibers, and the like.

In uncased wells, the zonal sealing of a specified open zone may generally be achieved by reducing the permeability of the formation rock by injecting viscous fluids into the specified zones. In one or more embodiments, the viscous fluids injected may comprise at least one of viscoelastic surfactant fluids, cross-linked polymer solutions, slick-water, foams, emulsions, dispersions of acid soluble particulate carbonates, dispersions of oil soluble resins, or any other viscosified fluid that may be subsequently dissolved or otherwise removed (such as by breaking of the viscosification).

For cased wells, zonal sealing of open zone(s) may be achieved by placing a solid removable sealing agent in the perforations or in the space between the formation rock and the casing. In one or more embodiments, the solid removable sealing agent may be a dissolvable material for zonal sealing, which may comprise acid soluble cement, calcium and/or magnesium carbonate, polyesters including esters of lactic hydroxycarbonic acids and copolymers thereof, active metals such as magnesium, aluminum, zinc, and their alloys, hydrocarbons with greater than 30 carbon atoms including, for example, paraffins and waxes, and carboxylic acids such as benzoic acid and its derivatives. Further, in one or more embodiments, the dissolvable solid removable sealing agent may be slightly soluble in a wellbore fluid at certain conditions and would have a long dissolution time in said fluid. Examples of combinations of removable sealing agents and wellbore fluids that result in slightly soluble dissolvable removable sealing agents are benzoic acid with a water-based wellbore fluid and rock salt with a brine in the wellbore fluid.

The solid removable sealing agent used for zonal sealing may be in any size and form: grains, powder, spheres, balls, beads, fibers, or other forms known in the art. In order to facilitate the delivery of the solid composition to the desired zone for sealing, the solid composition may be suspended in liquids such as gelled water, viscoelastic surfactant fluids, cross-linked fluids, slick-water, foams, emulsions, brines, water, and sea-water.

In one or more embodiments, the removable sealing agent may be a manufactured shape, at a loading sufficiently high to be intercepted in the proximity of the wellbore. The loading may be more than about 50 lb/1000 gal. The manufactured shape of the removable sealing agent may be round particles having dimensions that are optimized for sealing. Also, the particles may be of different shapes, such as cubes, tetrahedrons, octahedrons, plate-like shapes (flakes), oval, and the like. The removable sealing agent may be of any dimension that is suitable for sealing. For example, as described in U.S. Patent Application Publication No. 2012/0285692, the disclosure of which is incorporated by reference herein in its entirety, the removable sealing agent may including particles having an average particle size of from about 3 mm to about 2 cm. Additionally, the removable sealing agent may additionally include a second amount of particles having an average particle size from about 1.6 to about 20 times smaller than the first average particle size. Also, the removable sealing agent may include flakes having an average particle size up to 10 times smaller than the first average particle size.

In some embodiments, the removable sealing agent is a diverter pill. The diverter pill may be a diversion blend with fibers and degradable particles with a particular particle size distribution. The diverter pill may include about 2 to 100 bbl of a carrier fluid. The diverter pill may include a diversion blend that is used as a plug and may have a mass of 10 to 400 lbs. The diversion blend may include about 20 pounds to 200 lbs of fiber per 1000 gallons of blend. It may include about 20 to about 200 pounds of particles per 1000 gallons of blend. The diverter may include beads with an average size such as described in TABLE 1 of U.S. Patent Application Publication No. 2012/0285692 A1, which is hereby incorporated by reference in its entirety. Additionally, any other diverters that are used in the industry may qualify as removable sealing agents.

The delivery and placement of the removable sealing agent (including viscous fluids and solid compositions) for zonal sealing may be performed by bullheading the material downhole, spotting the material at the wellbore with a CT-line or slick-line, or by using downhole containers capable of releasing the material at a desired zone. In one or more embodiments, after spotting the removable sealing agent composition in the wellbore the removable sealing agent is injected into the zone to be sealed by increasing the pressure in the wellbore. Any excess of the removable sealing agent applied downhole may be removed from the wellbore by cleaning it out using a coiled tubing or washing line and an appropriate cleaner for the sealing material.

The mechanical strength of the removable seals created during the zonal sealing may be increased by compacting the removable seals with gluing systems such as epoxy resins or emulsion systems such as wax and paraffin emulsions. In one or more embodiments, the gluing systems for increasing the mechanical strength of the removable seals may be compounded with the solid removable sealing agent before placement in the wellbore or may be injected separately into the wellbore after sealing the zone with the removable sealing agent. An increase in the mechanical strength of the removable seals may also be achieved by compounding the solid removable sealing agents with at least one reinforcement agent chosen from the group including fibers, deformable particulates, and particles coated with temperature and/or chemically activated formaldehyde resins.

Further, as mentioned above, for cased holes, the workflow of the present disclosure may also include creating openings in the casing to create the one or more open zones and enable access to the formation. It is also within the scope of the present disclosure that zonal sealing may be combined with the creation of the open zone(s). For example, a sequence may include creation of open zone 1, sealing of open zone 1, creation of open zone 2, sealing of open zone 2, etc., which may be performed as many times as desired, and in combination with wellbore clean out if desired. This procedure may allow for the selective sealing of various wellbore zones with various removable sealing agents.

Once a target zone or zones has had its removable sealing agent selectively removed, treatment of the target zone may be performed. Further, as one or more other zones may still be sealed with removable sealing agents, such sealed zones may not be subjected to the treatment at the given stage, and in fact, may be inaccessible to such treatments given the removable sealing agent in place. In one or more embodiments, the at least one treatment may be a propped fracturing treatment, a non-propped fracturing treatment, a slick-water treatment, an acidizing acid fracturing, and/or an injection of chelating agents. The injecting fluid may be selected from one of water, slick-water, gelled water, brines, viscoelastic surfactants, cross-linked fluids, acids, emulsions, energized fluids, foams, and mixtures thereof.

Assuming one or more zones remain sealed (and such zones warrant treatment), after performing the at least one treatment stage, the treated zone may optionally be isolated or sealed in order to temporarily decrease or stop fluid penetration therein. This isolation or sealing may be achieved by several methods including plugging the perforations, the wellbore, or the annulus space between the casing and the borehole in the treated zone, including use of the various removable sealing agents described above. However, it is also within the scope of the present disclosure that conventional zonal isolation and diversion techniques may be used to isolate the treated zone such as pumping degradable and/or soluble ball sealers, setting sand or proppant plugs, setting packers, and bridge plugs including flow-through bridge plugs, and using completion conveyed tools such as sliding sleeves and wellbore valves. While sealing has been used to describe the sealing of the sandface, leaving the wellbore open, isolation is used to describe the complete closing off of a section or zone of the wellbore. When conventional zonal isolation and diversion techniques are utilized to effectively isolate a treated zone, the de-isolation of the treated zone may be performed by conventional techniques known in the art such as creating pressure draw across the casing to remove ball sealers from the perforation tunnels, wellbore clean out with a coiled tubing line, unsetting bridge plugs or milling them out, etc.

As mentioned above, the treated target zone may be sealed through the use of various removable sealing agents described above. For example, sealing of the treated zone may also be achieved using various particulate materials such as rock salt, oil-soluble resins, waxes, carboxylic acids, cements including acid soluble cements, ceramic beads, glass beads, and cellophane flakes. Additionally, permeability reduction in the treated target zone may be achieved by injecting viscous fluids, foams, emulsions, cross-linked fluids, viscoelastic surfactant fluids, brines, and mixtures thereof into the treated formation zone. Permeability reduction in the treated formation zone may also be achieved by injecting suspensions of solids such as carbonates, polyesters, rock salt, oil-soluble resins, waxes, carboxylic acids, and mixtures thereof.

In one or more embodiments, modification of the stress field in the treated zone may also be a way of sealing the target zone after treatment. Modifying the stress field in a treated target zone of the formation may be achieved by increasing the pore pressure in the treated target zone by injecting fluids including water, oil, foams, emulsions, cross-linked fluids, viscoelastic solid fluids, brines, and mixtures thereof. Alternatively, or in addition, the stress field may be modified by cooling or heating the formation rock in the treated target zone by using downhole heaters or coolers, or injecting heated or cooled fluids including energized fluids and gases in the treated zone of the formation.

As the operation progresses beyond the initially treated target zone(s), at least one of the sealed open zones may be selectively unsealed. That is, one or more wellbore zones sealed may be selectively unsealed to facilitate their treatment during the multi-stage treatment process. For embodiments using a solid, dissolvable component as the removable sealing agent, the selective unsealing of at least one sealed wellbore zone may be accomplished by contacting the removable sealing agent comprising the solid, dissolvable component with a suitable dissolving agent to dissolve the dissolvable component. In one or more embodiments, suitable dissolving agents may comprise at least one of inorganic acids (such as hydrochloric acid), organic acids (such as formic acid, acetic acid), hydroxides, ammonia, organic solvents, diesel, oil, water, brines, solutions of organic and/or non-organic salts, and mixtures thereof. For example, the dissolvable components calcium carbonate, boric acid, and paraffin are selectively dissolvable by 10% HCl, 10% NaOH, and hexane, respectively, while remaining substantially insoluble when contacted by other dissolving agents. In one or more other embodiments in which viscous fluids are used as the sealing material, the viscous fluids may be broken by breaker fluids known to reduce the viscosity thereof. For example, viscoelastic surfactants containing a quaternary amine group may possess a pH-dependent viscosity profile such that the fluid viscosifies at certain pH values, and may have a reduced viscosity at a lower pH value.

The delivery and placement of the dissolving agent or breaker for the selective removal of the removable sealing agent may be performed by bullheading the dissolving agent or breaker downhole, spotting the dissolving agent or breaker at the wellbore with tubing or a coiled tubing string (including any tubing with an inner diameter less than 1 inch), or by using downhole containers capable of releasing the dissolving agent or breaker at the sealed zone to dissolve or otherwise break the removable sealing agent. When using a fluid flush to deliver the dissolving agent or breaker to a sealed zone, it may be desirable to minimize contact of the fluid including the dissolving agent or breaker with sealed zones that are not intended to have the removable sealing agent removed and be unsealed, while maximizing the contact of the fluid including the dissolving agent or breaker with the sealed target zone or zones that are intended to have the removable sealing agent removed and be unsealed.

As mentioned above, in one or more embodiments, the aforementioned stages of treating the target zone, optional isolation or re-sealing of the treated target zone at stage, and/or selectively removing the removable sealing agent from a different untreated target zone may be repeated as many times as desired for the multi-stage treating of the specified wellbore interval. The decision about each stage and treatment continuation may be made on the multi-stage treatment job design and/or on data obtained during the multi-stage treatment process.

Specifically, in one or more embodiments, a cased wellbore open zone sealing may utilize a sequence, performed at least one time, comprising creating an open zone in the casing and sealing the created open zone with a removable sealing agent. Utilizing this sequence may allow for the sealing of the created wellbore zones with solid removable sealing agents comprising different dissolvable components. For example, the three solid dissolvable components may be used in a system for sealing at least three different zones, each with a different solid removable sealing agent. Thus, in one or more embodiments, a zonal sealing method may utilize a sequence of creating and/or sealing a first open zone with a solid removable sealing agent comprising a first dissolvable component, creating and/or sealing a second open zone with a solid removable sealing agent comprising a second dissolvable component, and repeating the sealing process with different dissolvable components as many times as desired for the chosen treatment process. In particular embodiments, the steps of using a dissolving agent to selectively unseal a previously sealed zone to create an opened target zone and performing a treatment on the created open target zone may be substituted anywhere in the sequence recited above.

Eventually, after the desired zones have been treated, communication between sealed or isolated zones and the wellbore may be reestablished so that the job can be completed and the wellbore can be put into production. The sealed and isolated zones of the wellbore may be unsealed and de-isolated using the techniques described above. Specifically, de-isolation techniques may include, for example, creation of pressure draw across a casing to remove ball sealers from perforation tunnels, wellbore clean-out with coiled tubing, unsetting bridge plugs and milling them out, etc.

In some embodiments, the multi-stage treatment method outlined above may be applied to wellbores that have zones that have previously undergone stimulation treatments. In this way, the wellbore may undergo re-stimulation treatments of the previously treated zones or the removable sealing agents may serve to seal the previously treated zones while untreated zones undergo stimulation treatments via a multi-stage treatment method. Types of treatments that zones of a wellbore may have undergone or that may be repeated (re-stimulation) during embodiments of a multi-stage treatment method described herein generally include fracturing operations, high-rate matrix treatments and acid fracturing, matrix acidizing, and injection of chelating agents.

In one or more embodiments, in a wellbore that has at least one zone that has previously undergone stimulation treatments there may exist at least one open zone. The at least one open zone may be one of the zones of the wellbore that has previously undergone stimulation treatments or the open zone may not have previously undergone stimulation treatments. Additionally, there may be a combination of open zones that have been treated along with zones that have not previously undergone stimulation treatments. Subsequently, at least one open zone of the wellbore may be sealed with one or more removable sealing agents, while leaving at least one open zone unsealed. The at least one open zone may then be treated while the at least on other zone is sealed. Following the treatment, access may be enabled to at least one zone. In some embodiments, enabling access to at least one zone may include selectively removing at least one removable sealing agent from a zone that was previously sealed. In some embodiments, enabling access may include creating an open zone by perforating the wellbore casing with perforating charges, jetting with a coiled tubing (CT) line or slick-line conveyed tools, cutting the casing, manipulating at least one sliding sleeve or wellbore casing valve within the wellbore or any other known methods for creating an open zone in a well. In some embodiments, manipulating at least one sliding sleeve or wellbore casing valve within the wellbore or the creation of an open zone within a wellbore may enable access to an untreated zone of the formation.

Further, it is also within the scope of the present disclosure that creation of openings in a casing may involve controlled dissolution of a sealing material that is in a plugged or sealed zone. In such a case, the removable sealing agent may be slightly soluble in a wellbore fluid at certain conditions and would have a long dissolution time in said fluid. Upon extended exposure to such wellbore fluid, the removable sealing agent may dissolve and reveal openings. Examples of combinations of removable sealing agents providing slightly soluble dissolvable components are benzoic acid with a water-based wellbore fluid as the dissolving agent and rock salt with brine in the wellbore fluid as the dissolving agent.

After treatment of the interval 28 is completed in accordance with the embodiments of FIG. 11D, in some embodiments the isolation object 18 may be removed from the target depth 12 and retrieved via the cable 32, or by other retrieval systems or methods as previously mentioned, e.g., a separate wireline, coiled tubing, tractor, self-propulsion, pump-out, flotation, etc. In some other embodiments, the cable 32 may be disengaged from the isolation object 18 and retrieved separately, e.g., by initiating an electrical, mechanical or chemical weak point to break the link with the isolation object 18. In these embodiments the isolation object 18 may be abandoned downhole, retrieved separately, and/or where it is degradable, removed from the target depth by initiating the appropriate degradation and/or removal protocol.

After treatment of the interval 28 is completed in accordance with the embodiments of FIGS. 11A-11D, or completed to the extent the particular treatment is facilitated or desired by maintaining the isolation effected by the isolation object 18 below the interval 28, in some embodiments the procedure of FIGS. 11A-11D can be repeated iteratively one or more additional times in a different interval associated with a different target depth, e.g., one or more successively higher target depths and intervals. In some embodiments, where the isolation object 18 is movable, for example, the object 18 may be successively disengaged from isolation at the target depth 12, relocated above the treated interval 28, and re-set above the interval 28 and below the next interval in the series to be treated, and so on. If desired, other intervals (not shown) above the isolation object 18 may be treated concurrently and/or serially, e.g., by optionally relocating and setting the object 18 above the previously treated zones, removing any associated plugs or diverters, and/or introducing a treatment fluid into the fracture zone(s) of the successively higher intervals. In other embodiments, successively lower intervals/target depths may be serially treated for "heel-to-toe" treatment in a similar manner, e.g., to total depth.

Figure 12A:
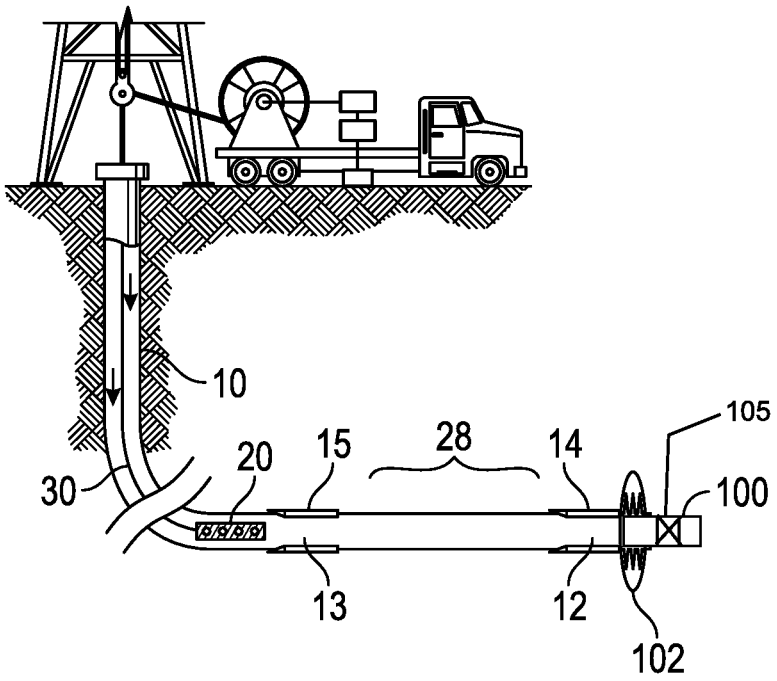
FIG. 12A schematically shows a well configuration according to first operational sequence in another multi-stage treatment according to embodiments of the disclosure.

With reference to FIGS. 12A-12D, well configurations according to some embodiments of another representative operational sequence are schematically illustrated, wherein like reference numerals correspond to like parts with respect to FIGS. 11A-11D. In FIG. 12A, the well 10 is shown with predetermined target depths 12, 13 at which the respective retaining subs 14, 15 have been installed with the casing 16 during placement thereof. The perforating gun 20 is shown en route to the interval 28.

Also shown in FIG. 12A is an initiation sub 100 that has been installed at the toe or total depth of the well 10, and has been utilized to treat a first stage and form the corresponding first fracture zone 102, which may be used for pump down operations in some embodiments. In embodiments, the initiation sub 100 comprises an initiator rupture disk valve (RDV) 105 that can eliminate an intervention trip into the well 10 that would otherwise be required by the method described, for example, in U.S. Pat. No. 6,543,538. The RDV 105 in some embodiments allows for the first fracture zone 102 to be initiated easily and without intervention. The RDV 105 in some embodiments contains two rupture discs that block the flow and pressure from the well 10 to the inside of the tool 100. Once the RDV 105 is pressured up and activated according to some embodiments, pumping of the first fracturing zone 102 can be performed at the desired rate and proppant concentration through helical slots in the sub 100 without the need for perforation with a perforating device.

The initiator valve 100 in these embodiments may be activated by increasing bottom-hole pressure slightly above the casing test pressure, which causes one or both of the rupture disks to fail and a sleeve in the valve 100 to open, exposing any cement sheath and the formation to the wellbore fluid; and the first zone 102 can be fractured via the RDV before pump-down plug-and-perf operations begin. Injectivity of the well 10 can be established in some embodiments by fracturing via the initiation sub 100, so that some or all of the subsequent placement of tools and/or treatment fluids can be done by pumping with a motive fluid that can egress from the well 10 via the fracture zone 102.

Suitable rupture disk valves, such as the rupture disk valve 105, are described for example in SPE 162658.

Figure 12B:
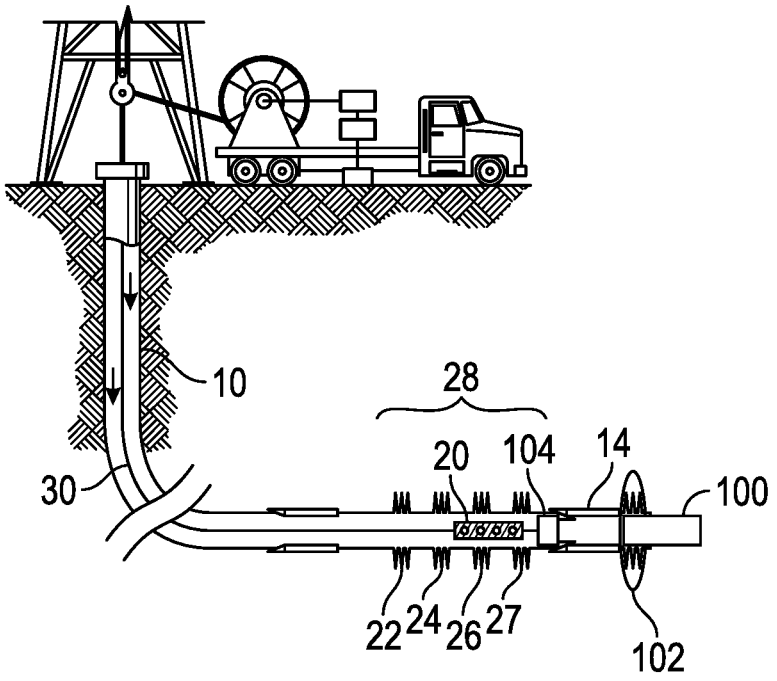
FIG. 12B schematically shows a well configuration according to second operational sequence in the multi-stage treatment of FIG. 12A in accordance with embodiments of the present disclosure.

With reference to FIG. 12B, in the next operational sequence according to some embodiments, the perforating gun 20 is deployed in the well 10 to perforate a plurality of perforation zones 22, 24, 26, 27 in the interval 28 by pumping the gun 20 to depth and shooting clusters in the target interval 28 via wireline 30.

Figure 12C:
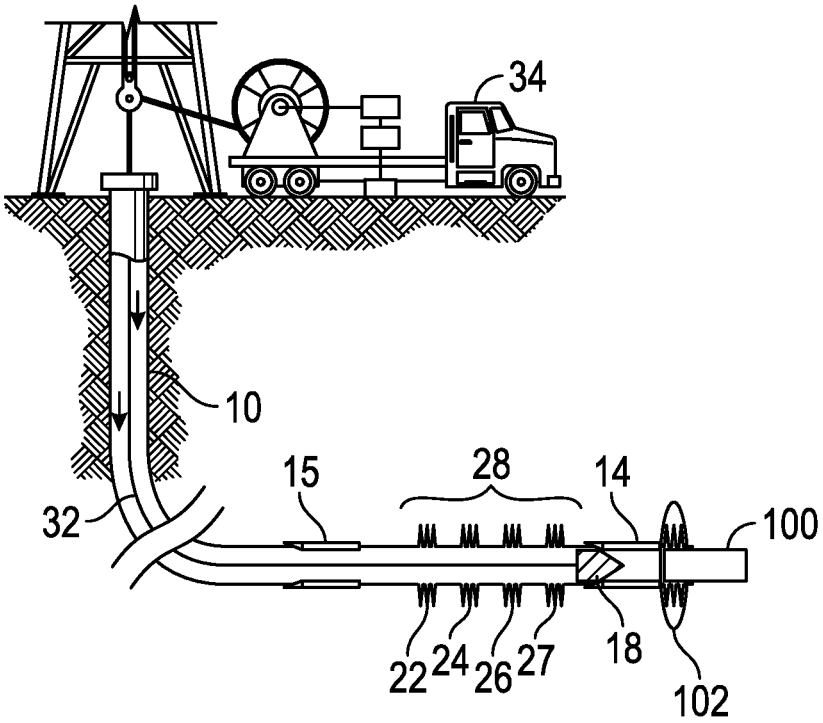
FIG. 12C schematically shows a well configuration according to third operational sequence in the multi-stage treatment of FIGS. 12A and 12B in accordance with embodiments of the present disclosure.

With reference to FIG. 12C, in the next operational sequence according to some embodiments, the dissolvable isolating object 18 is shown tethered to the distributed measurement cable 32 and deployed to seat in the retaining sub 14, in a manner similar to FIG. 11C.

Figure 12D:
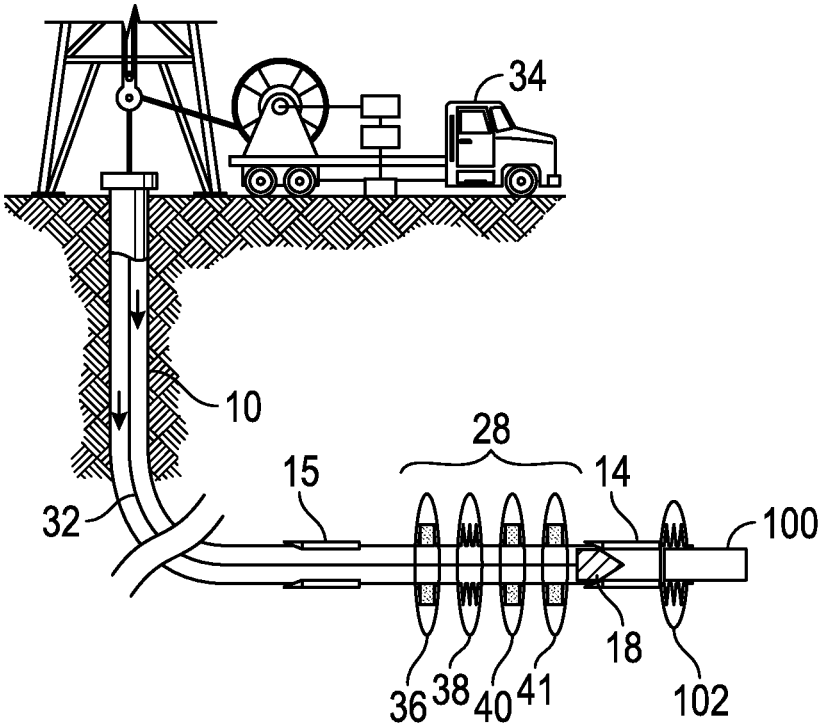
FIG. 12D schematically shows a well configuration according to a fourth operational sequence in the multi-stage treatment of FIGS. 12A, 12B, and 12C in accordance with embodiments of the present disclosure.

With reference to FIG. 12D, in the next operational sequence according to some embodiments, the isolation object 18 is tightly set to isolate the interval 28 from the lower section of the well 10 containing the first fracture zone 102, and the interval 28 is treated by injecting a fracturing treatment fluid via the perforation zones 22, 24, 26, 27 (see FIG. 2C) while monitoring treatment progress via the cable 32 to form respective fracture zones 36, 38, 40, 41, in a manner similar to FIG. 11D. In some embodiments, following the treatment of zone 28, a weak point is activated and the cable 32 is pulled out of the hole, in preparation for repeating the operational sequence for treating a zone above the next higher retention sub 15.

Although only a few example embodiments have been described in detail above, those skilled in the art will readily appreciate that many modifications are possible in the example embodiments without materially departing from this invention. For example, any embodiments specifically described may be used in any combination or permutation with any other specific embodiments described herein.

Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method for multi-stage well treatment, comprising:

(a) perforating a first interval in the well above a first target depth;

(b) deploying to the first target depth an isolation object tethered to a distributed measurement cable from the surface, the distributed measurement cable having a polymeric outer jacket disposed about at least one inner polymeric jacket, wherein the measurement cable has a core disposed within the at least one inner polymeric jacket, the core being at least one optical fiber conductor;

(c) isolating the well at the first target depth with the isolation object by directly seating the isolation object against an inner diameter restriction of a retention sub installed at the first target depth;

(d) treating the first perforated interval in a plurality of stages; and (e) concurrently with (d), receiving measurements from the distributed measurement cable for monitoring each stage of the treatment;

wherein the perforation (a), the deployment (b), the isolation (c), and the treatment (d) concurrently with the monitoring (e) are performed in the recited order.

2. The method of claim 1, further comprising detaching the distributed measurement cable from the isolation object, and removing the distributed measurement cable from the well.

3. The method of claim 1, further comprising leaving the distributed measurement cable in the well, initiating production from the first treated interval and concurrently obtaining measurements from the distributed measurement cable to monitor the production.

4. The method of claim 1, further comprising repeating the perforation (a), deployment (b), isolation (c), treatment (d), and monitoring (e), one or more times with respect to successive intervals above successively higher target depths.

5. The method of claim 1, further comprising treating a stage below the first target depth prior to treatment of the first interval.

6. The method of claim 5, wherein the stage below the first target depth is treated prior to perforating the first interval.

7. The method of claim 5, wherein treating the stage below the first target depth comprises actuating a rupture disk valve.

8. The method of claim 5, wherein treating the stage below the first target depth comprises deploying one or more perforating guns below the first target depth to initiate fluid entry into the stage below the first target depth.

9. The method of claim 1, further comprising installing the retention sub with a casing string at the first target depth.

10. The method of claim 1, wherein the isolation object comprises a degradable ball.

11. The method of claim 1, wherein the measurements received are selected from fluid flow rate, distributed temperature, distributed vibration, distributed pressure, and combinations thereof.

12. The method of claim 1, wherein the treatment (d) comprises fracturing.

13. The method of claim 12, wherein the fracturing comprises pumping a treatment fluid comprising proppant laden stages separated by one or more diverter pills.

14. The method of claim 13, further comprising adjusting in (d) one or more of respective sizes of the proppant laden stages, number of the diverter pills, and volumes of the diverter pills, in response to the measurements received in (e).

15. A method for multi-stage well treatment, comprising:

(a) installing in a casing string an initiation sub adjacent a toe of the well, wherein the initiation sub comprises a rupture disk valve;

(b) installing in the casing string a plurality of retention subs at a first target depth and one or more successively higher target depths above the initiation sub;

(c) actuating the initiation sub to treat a stage adjacent the initiation sub, wherein actuating the initiation sub comprises bursting the rupture disk valve;

(d) perforating a first interval in the well above the first target depth;

(e) deploying to the first target depth an isolation object tethered to a distributed measurement cable from the surface, the distributed measurement cable having a polymeric outer jacket disposed about at least one inner polymeric jacket, wherein the measurement cable has a core disposed within the at least one inner polymeric jacket, the core being at least one optical fiber conductor;

(f) directly seating the isolation object deployed in (e) against an inner diameter restriction of the retention sub installed at the first target depth to isolate the well at the first target depth;

(g) treating the first perforated interval in a plurality of stages;

(h) concurrently receiving measurements from the distributed measurement cable for monitoring each stage of the treatment in (g);

(i) detaching the distributed measurement cable from the isolation object seated in (f); and (j) repeating at least the perforation in (d), the deployment in (e), the seating in (f), the treatment in (g), and the monitoring in (h), one or more times with respect to successively higher intervals above the respective one or more successively higher target depths.

16. The method of claim 15, further comprising:

(k) concurrently conveying landing seat installation tools to the respective retention subs, and perforating tools to the respective intervals, with a wireline; and (l) installing landing seats with the respective landing seat installation tools in the respective retention sub to receive the respective isolation objects.

17. The method of claim 15, further comprising removing the isolation object.

18. The method of claim 15, wherein the measurements received are selected from fluid flow rate, distributed temperature, distributed vibration, distributed pressure, and combinations thereof.

19. The method of claim 15, wherein the treatments in (c) and (g) comprise fracturing treatments.

20. The method of claim 19, wherein the fracturing treatments in (g) comprise pumping a treatment fluid comprising proppant laden stages separated by one or more diverter pills.

21. The method of claim 20, further comprising adjustment during the fracturing treatments in (g) one or more of respective sizes of the proppant laden stages, number of the diverter pills, and volumes of the diverter pills, in response to the measurements received in (h).

22. The method of claim 19, wherein the fracturing treatments in (g) comprise sealing at least one open zone of the respective interval with at least one removable sealing agent, selectively removing the removable sealing agent from at least one target zone, and fracturing the at least one target zone.

23. The method of claim 22, wherein the fracturing treatments in (g) occur while at least one open zone of the well is sealed with at least one removable sealing agent.

24. The method of claim 22, wherein the removable sealing agent comprises manufactured shapes selected from at least one of particulates, fibers, flakes, rods, pellets and combinations thereof.

25. The method of claim 19, wherein the fracturing treatments in the respective intervals in (g) comprise:

sealing, with a removable sealing agent, all but one of a plurality of open zones in the respective interval;

fracturing the open zone while the other zones in the respective interval are isolated or sealed or a combination thereof;

sealing the fractured zone or isolating the section of the respective interval comprising the fractured zone;

selectively removing the removable sealing agent from an untreated sealed zone; and repeating the sequence of fracturing the open zone while the other zones are isolated or sealed, isolating or sealing the fractured zone, and selectively removing the removable sealing agent from a sealed un-fractured zone until the desired number of zones are fractured.

26. A system for multi-stage well treatment, comprising:

(a) a perforating system to convey a perforating device to perforate an interval in the well above a target depth;

(b) a deployment system to deploy an isolation object tethered to a distributed measurement cable from the surface to the target depth and isolate the well at the first target depth with the isolation object by directly seating the isolation object against an inner diameter restriction of a retention sub installed at the target depth, the distributed measurement cable having a polymeric outer jacket disposed about at least one inner polymeric jacket, wherein the measurement cable has a core disposed within the at least one inner polymeric jacket, the core being at least one optical fiber conductor;

(c) a treatment system to treat the perforated interval with a treatment fluid in a plurality of stages; and (d) a distributed measurement collection system to receive and interpret measurements from the distributed measurement cable during the treatment to monitor the plurality of the treatment stages.

27. The system of claim 26, further comprising a weak point activatable to detach the distributed measurement cable from the isolation object for removal of the distributed measurement cable from the well.

28. The system of claim 26, wherein the perforating, deployment, treatment and distributed measurement collection systems are operable to repeat the perforation, deployment, treatment, and measurement interpretation with respect to one or more successively higher target depths and respective intervals.

29. The system of claim 26, wherein the optical fiber conductor comprises:

a pair of half-shell conductors;

an insulated optical fiber located between the pair of half-shell conductors, wherein the insulated optical fiber is coupled with the pair of half-shell conductors; and an optical fiber conductor jacket disposed about the pair of half-shell conductors.

* * * * *